US007423602B2

(12) United States Patent
Lockie et al.

(10) Patent No.: US 7,423,602 B2
(45) Date of Patent: Sep. 9, 2008

(54) MULTIPLE-POINT TO MULTIPLE-POINT COMMUNICATION SYSTEM

(75) Inventors: Douglas Gene Lockie, Los Gatos, CA (US); Mark Alan Sturza, Encino, CA (US)

(73) Assignee: GigaBeam Corporation, Durham, NC (US)

( * ) Notice: Subject to any disclaimer, the term of this patent is extended or adjusted under 35 U.S.C. 154(b) by 205 days.

(21) Appl. No.: 11/499,852

(22) Filed: Aug. 4, 2006

(65) Prior Publication Data

US 2007/0057858 A1 Mar. 15, 2007

Related U.S. Application Data

(60) Provisional application No. 60/707,888, filed on Aug. 12, 2005.

(51) Int. Cl.
*H01Q 3/00* (2006.01)

(52) U.S. Cl. ..... 343/766; 343/763; 455/422; 455/562

(58) Field of Classification Search ..... 343/766, 343/763, 753, 822; 455/422, 562
See application file for complete search history.

(56) References Cited

U.S. PATENT DOCUMENTS

| | | | | |
|---|---|---|---|---|
| 6,034,642 | A * | 3/2000 | Kojima et al. | 343/753 |
| 6,396,448 | B1 * | 5/2002 | Zimmerman et al. | 343/753 |
| 6,587,699 | B2 * | 7/2003 | Olsen et al. | 455/562.1 |
| 6,646,620 | B1 * | 11/2003 | Bjornholt et al. | 343/882 |
| 2005/0110674 | A1 * | 5/2005 | Mendolia et al. | 342/81 |
| 2005/0159187 | A1 * | 7/2005 | Mendolia et al. | 455/562.1 |

* cited by examiner

*Primary Examiner*—Huedung Mancuso

(57) ABSTRACT

Methods and apparatus for a high speed wireless communication system are disclosed. The high speed wireless links are accomplished using relatively narrow beams (<1°). These beams are produced using rotational motion at a base station in the center of a cell. In one embodiment of the invention, a radio and an antenna are mounted on a rotating element attached to a vertical mast. In another embodiment, a rotating mirror is employed to produce reflected beams. The present invention may be implemented using the 71-76 GHz, 81-86 GHz, and/or 92-95 GHz frequency bands.

20 Claims, 36 Drawing Sheets

Single Antenna Rotating on a Vertical Axis
Mounted on Pedestal to H___ Antenna & Radio Beacon Concept For
MM Wave Communications System Multiple Radios & Antennas
Mounted on Rotating Pedestal Fixed Radio & Antenna (Vertical Orientation)
& Rotating Mirror Antenna Tilted ±25° From Vertical to Result in ±25° Elevation Tilt From Reflected Beam Elevation Control Implemented With ±25° Change in Mirror & With Fixed Vertical Angle From Radio & Antenna CTS Antenna With Phase Control Feed
to Implement Elevation Control Vertical Radio Beam Above & Below
Rotating Mirror Creates Two Simultaneous Beams Beacon Loacted at Corners of Building
Each Connecting 1/2 to 1/4 of Cell, Enabling
Viewing Angles Fig. 13 Four Sided Mirror with Radio/Antenna Feed External to Rotational Axis Four Sided Mirror with 30° Mirror Tilt & 60° Radio/Antenna Angle Radio System Architecture With Buffer to Provide Continuity During Burst Mode Operation Remote Terminal Low Cost Architecture Low Cost Remote Terminal Architecture Present Invention Overlayed on SoFab Hardware & Software Social Fabric Operating in Conjunction with Present Invention Present Invent. Attached to BPL & CDL

MULTIPLE-POINT TO MULTIPLE-POINT COMMUNICATION SYSTEM

CROSS-REFERENCE TO A RELATED PENDING PROVISIONAL PATENT APPLICATION & CLAIMS FOR PRIORITY

This Non-Provisional Patent Application is related to a Pending Provisional Patent Application, U.S. Ser. No. 60/707,888, filed on 12 Aug. 2005. In accordance with Sections 119 and/or 120 of Title 35 of the United States Code of Laws, the Applicants claim the benefit of priority for any subject matter which is common to the Pending Provisional and the Present Non-Provisional Patent Applications.

FIELD OF THE INVENTION

The present invention pertains to methods and apparatus for a high speed, wireless communication system. More particularly, one embodiment of the invention employs a rotating beam that emanates from and/or to a central base station to provide high speed wireless communications.

BACKGROUND OF THE INVENTION

Providing high speed communication links for a number of fixed and/or mobile terminals can be extremely expensive. Conventional links may include wire or optical fiber cables. Obtaining rights-of-way and permits to build these in-ground facilities can be costly and time consuming. Conventional microwave links operate at relatively slow speeds, and may cause unwanted interference among the many radio receivers that are installed in and on the buildings.

The difficulty and expense of supplying broadband data links at the edges of the communication network has been described as the "Last Mile Problem." Only about five percent of the 750,000 commercial buildings in the United States are connected by optical fibers. Businesses that reside in the remaining ninety-five percent of commercial buildings need the high speed service offered by fiber, but are unable to obtain a fiber connection, can not afford a fiber connection, or do not have the time to wait for the installation of a fiber connection.

No current commercially-available device or system provides a readily available, relatively inexpensive high speed connection for a number of fixed and/or mobile terminals. The development of such a system would constitute a major technological advance, and would satisfy long felt needs and aspirations in the telecommunications business.

SUMMARY OF THE INVENTION

The present invention provides a high speed, wireless communication system for fixed and/or mobile terminals using a central base station antenna that produces a rotating or moving beam. In one embodiment of the invention, a antenna and a radio are mounted on top of a rotating pedestal or platform. In another embodiment, an antenna and a radio are employed in combination with a rotating mirror.

An appreciation of the other aims and objectives of the present invention, and a more complete and comprehensive understanding of this invention, may be obtained by studying the following description of preferred and alternative embodiments, and by referring to the accompanying drawings.

A BRIEF DESCRIPTION OF THE DRAWINGS

FIG. 1 depicts a base station antenna that includes a rotating beacon.

FIG. 2 provides a detailed view of the beacon, which resides on top of a pedestal that is mounted to a mast.

FIG. 3 shows a beacon that is equipped with multiple radios and antennas.

FIGS. 4 and 5 exhibit alternative embodiments of the invention which utilize a fixed radio and antenna together with a rotating mirror.

FIG. 6 presents a detailed view of the rotating mirror.

FIG. 7 portrays a rotating mirror with variable tilt.

FIG. 8 illustrates an antenna with phase control and radiating elements that provide electronic beam steering.

FIG. 9 combines the electronic beam steering feature shown in FIG. 8 with a rotating mirror.

FIG. 10 depicts an antenna with an oversized mirror.

FIG. 11 supplies a view of an alternative embodiment that incorporates a radio and an antenna both above and below a rotating mirror.

FIG. 12 offers a view of a building with four rotating beacon antennas installed at each of the four corners of the roof of the building.

FIG. 13 displays a rotating antenna which is configured with four reflecting sides.

FIG. 14 provides a view of a rotating antenna with a thirty degree mirror and a sixty degree antenna angle.

FIG. 15 presents a view of a mirror with multiple facets.

Figure 19:
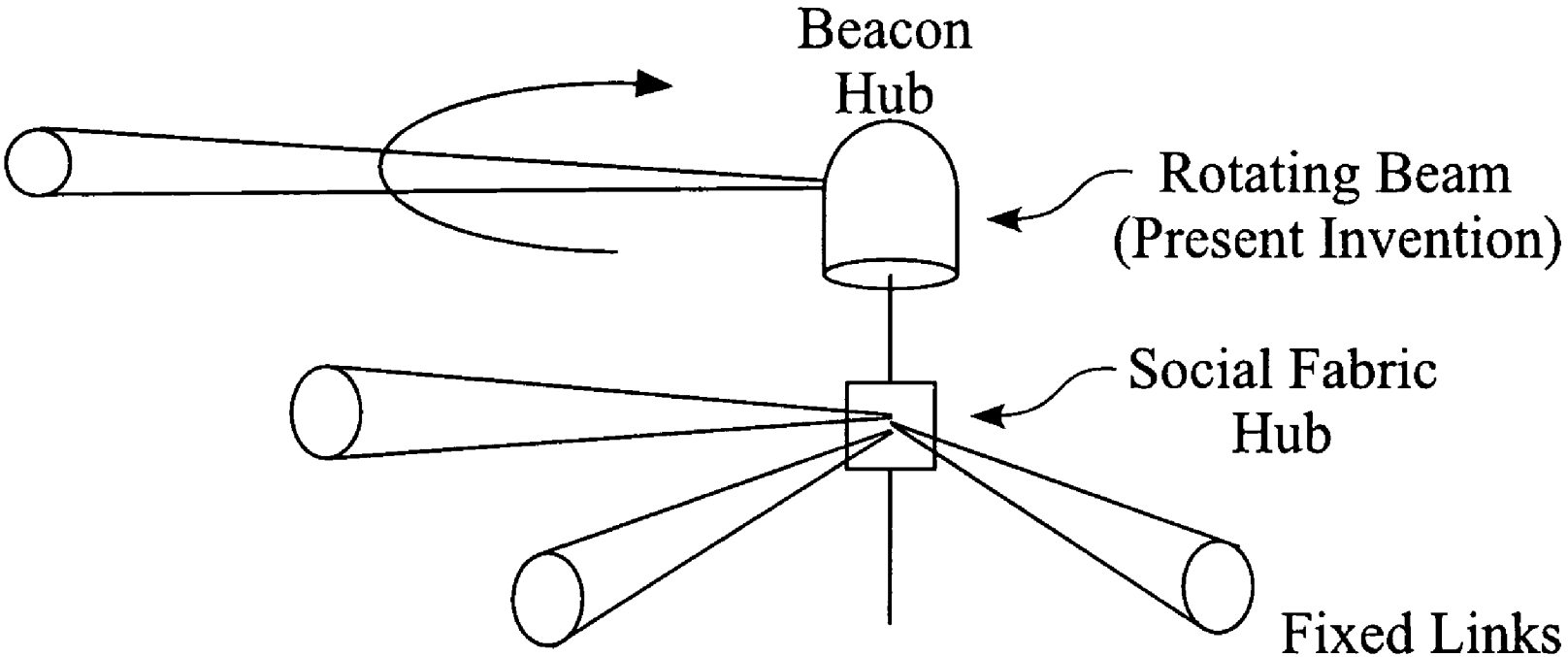

FIG. 19 furnishes a view of an alternative embodiment of the invention which offers a lower data rate, combined with generally ubiquitous coverage.

Figure 20:
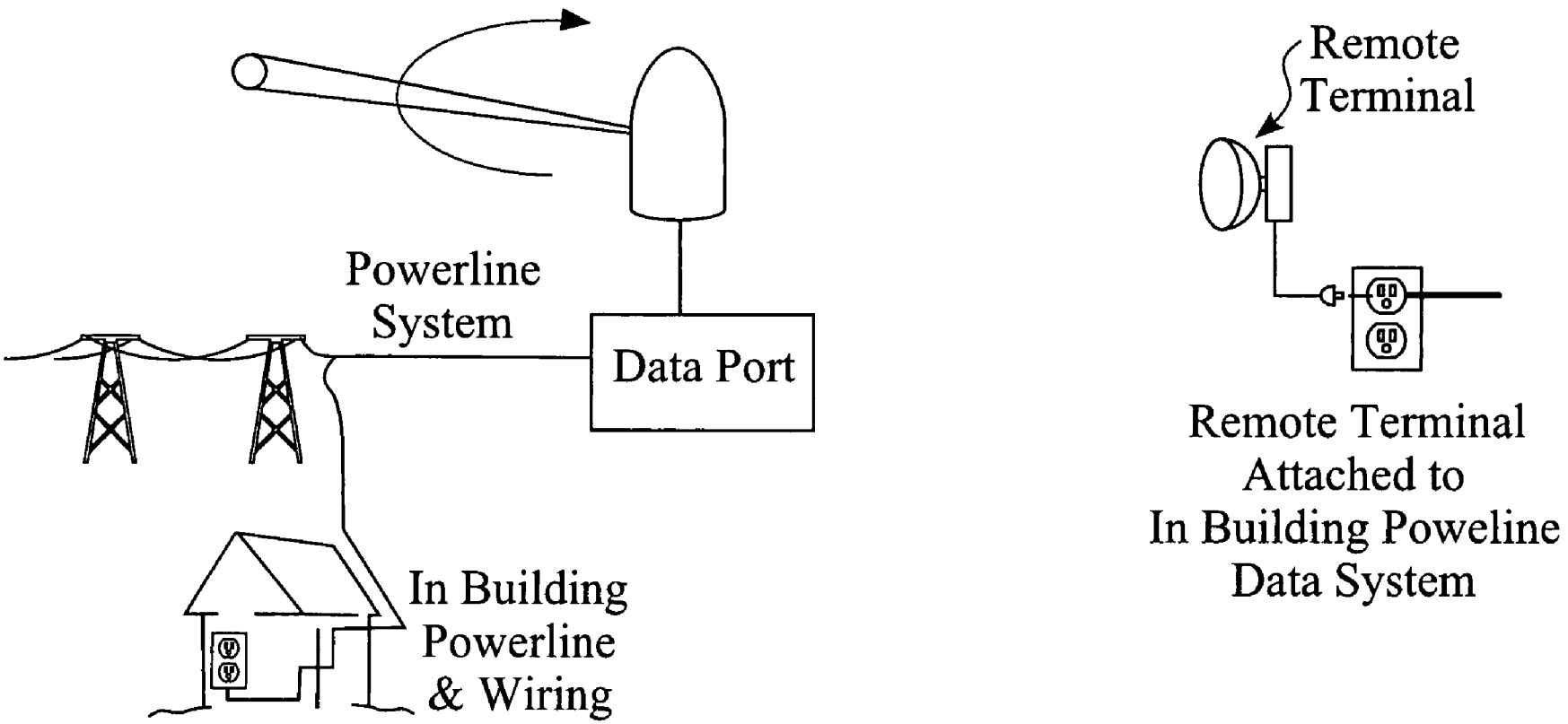

FIG. 20 portrays an embodiment of the invention that supplies communications over power lines.

Figure 21:
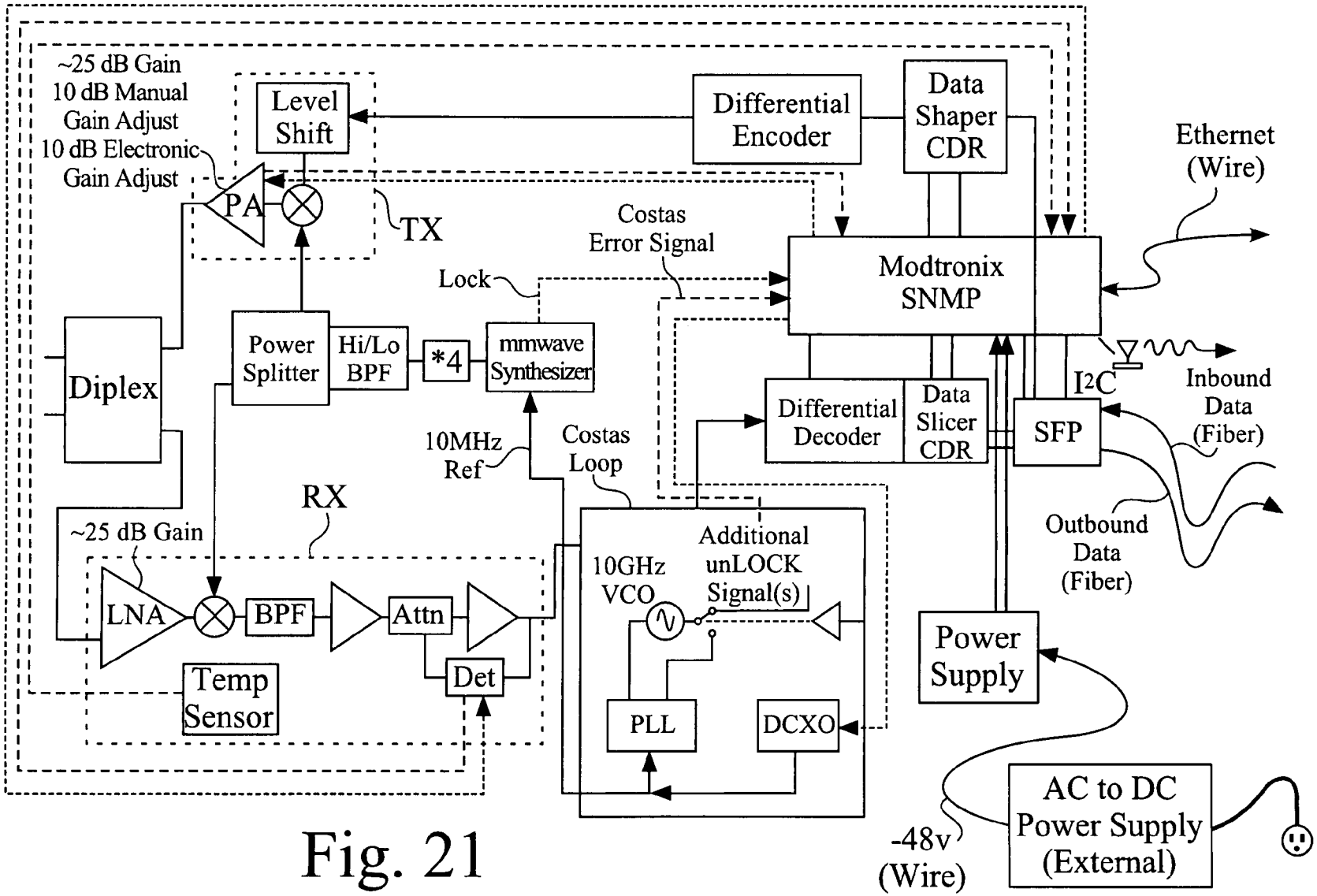

FIG. 21 is a schematic diagram of an exemplary millimeter wave radio of one embodiment of the invention.

Figure 22:
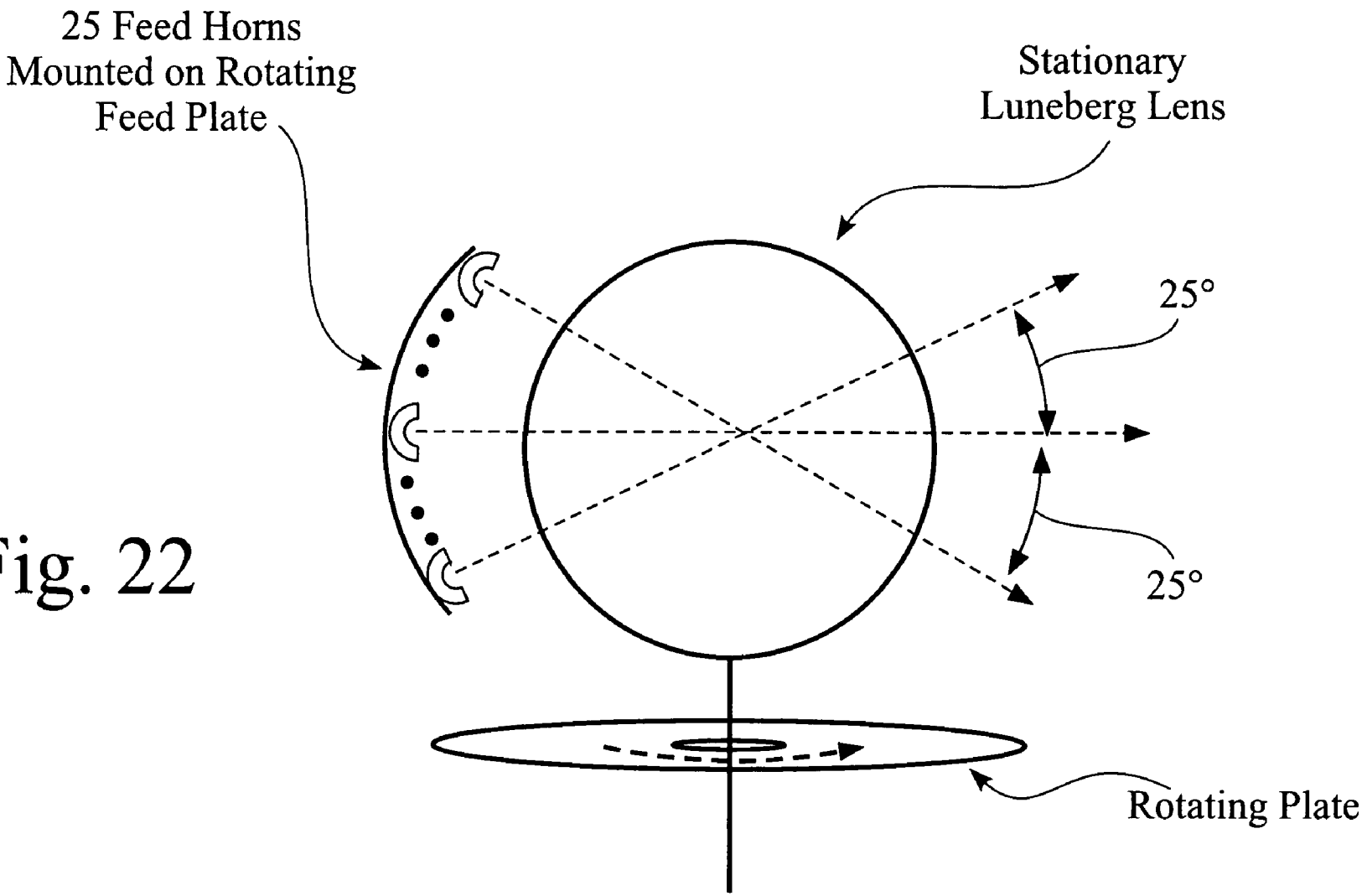

FIG. 22 provides a view of an Antenna System having a fixed Luneberg lens with a rotating feed arm.

Figure 23:
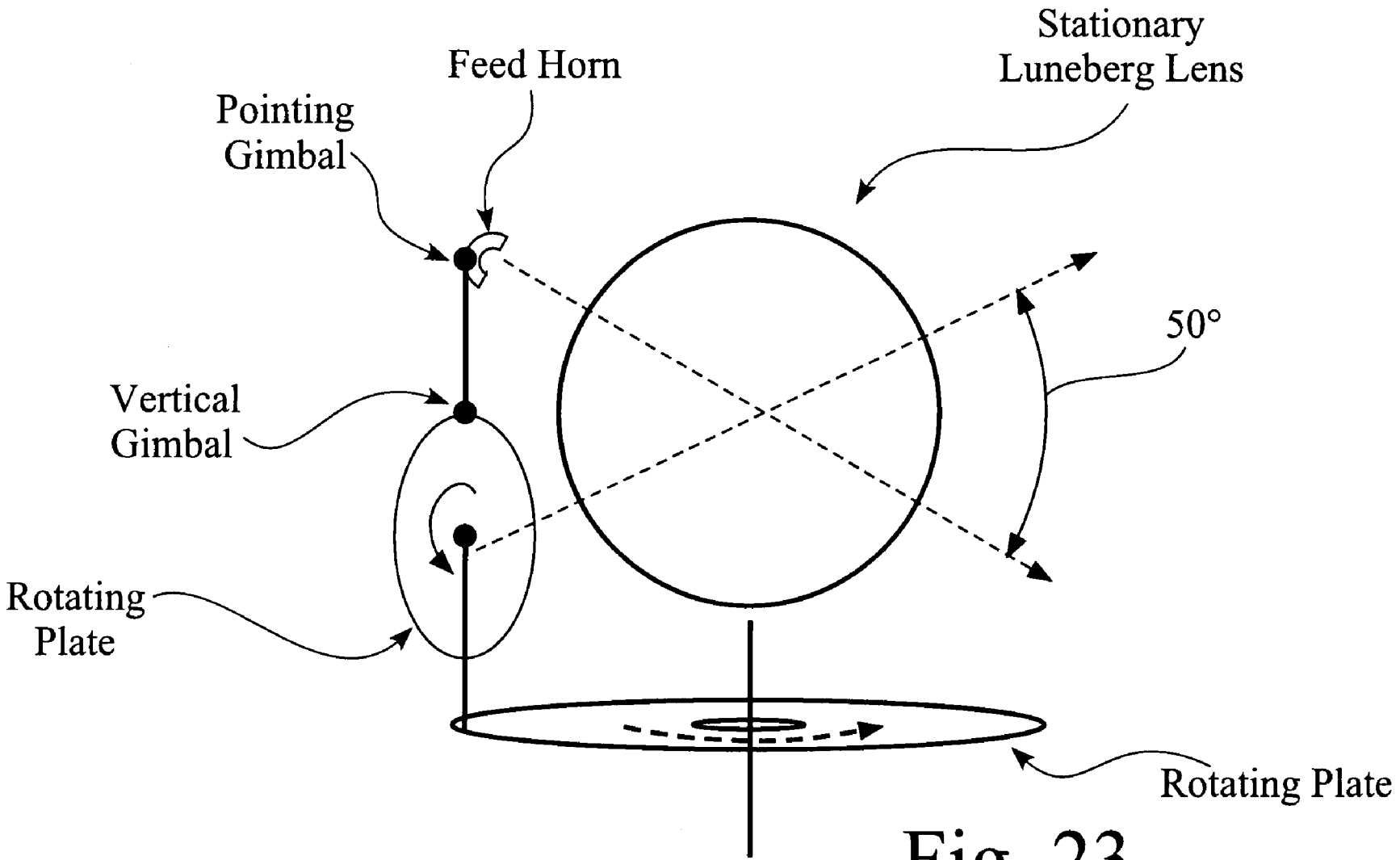

FIG. 23 is a schematic view of an Antenna System having a single feed horn that rotates around the a Luneberg lens in a pattern to ensure that every cell is addressed.

Figure 24:
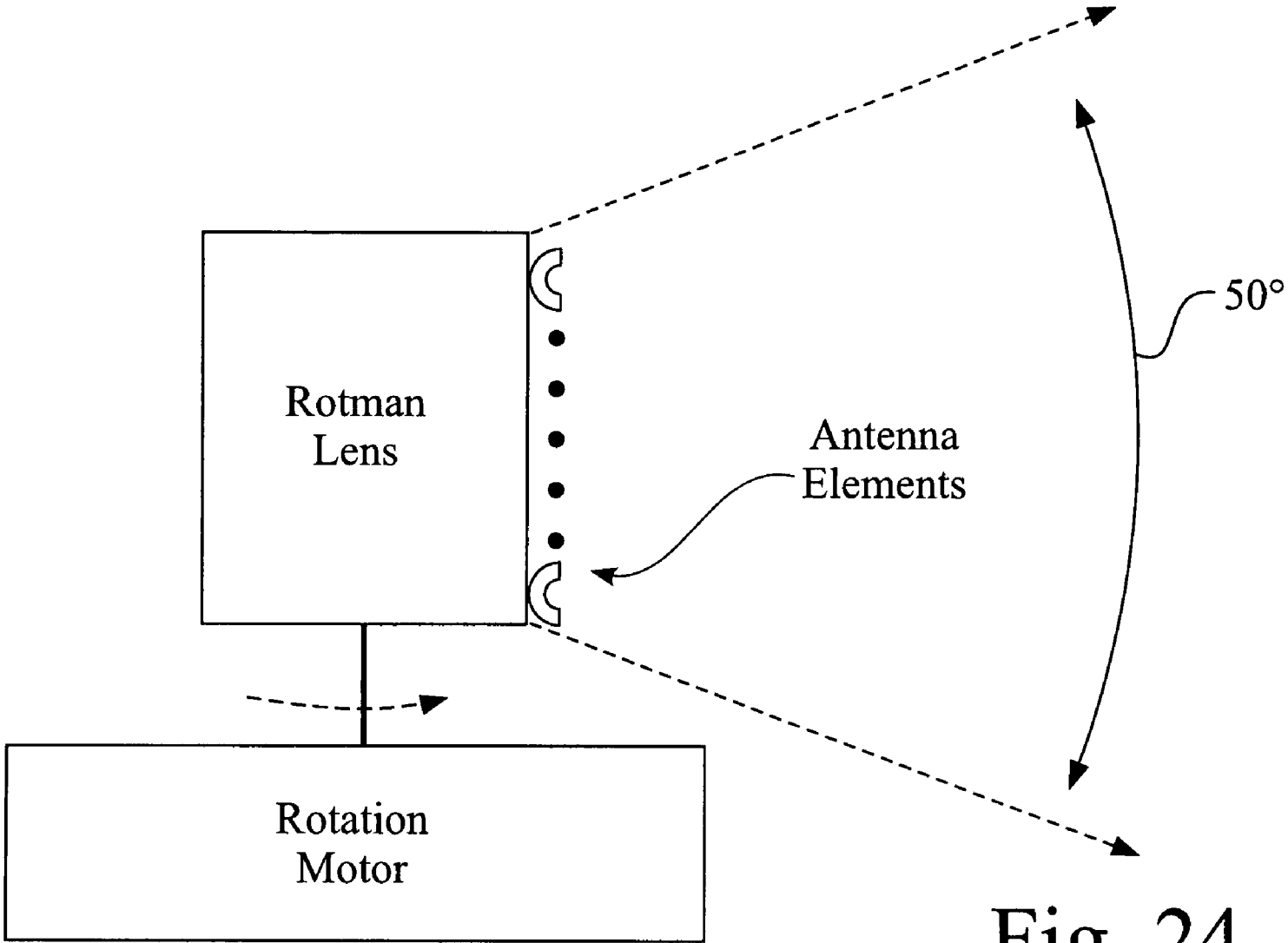

FIG. 24 shows a rotating 1-D Rotman lens antenna system.

Figure 26:
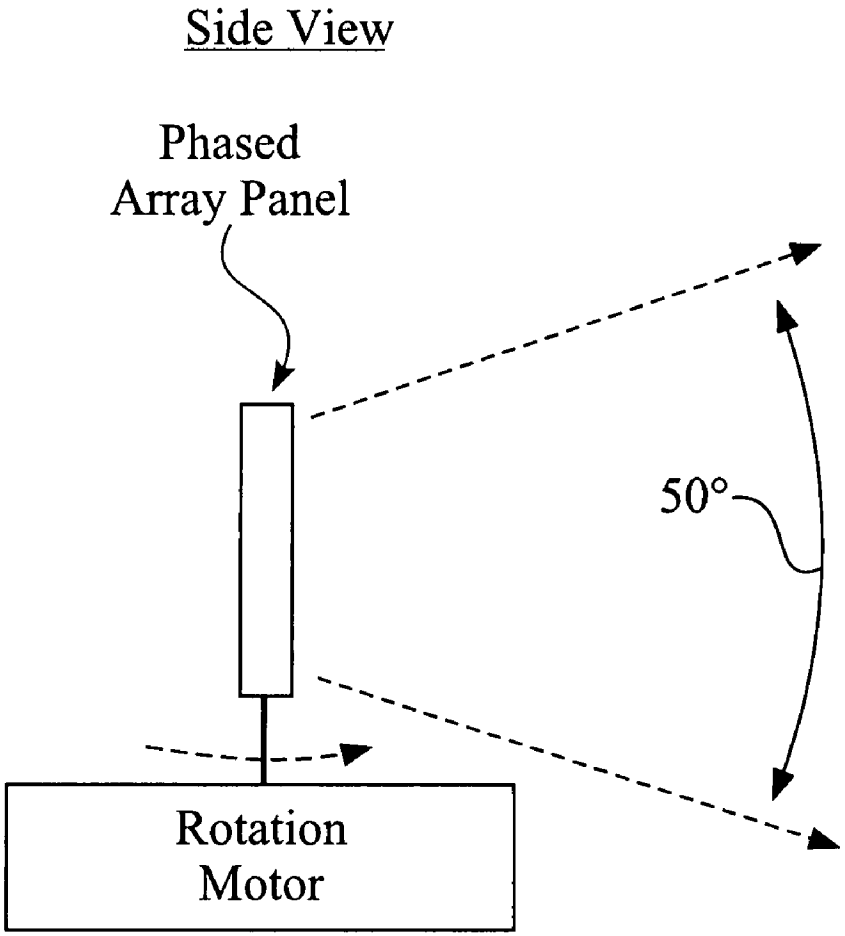
Figure 25:
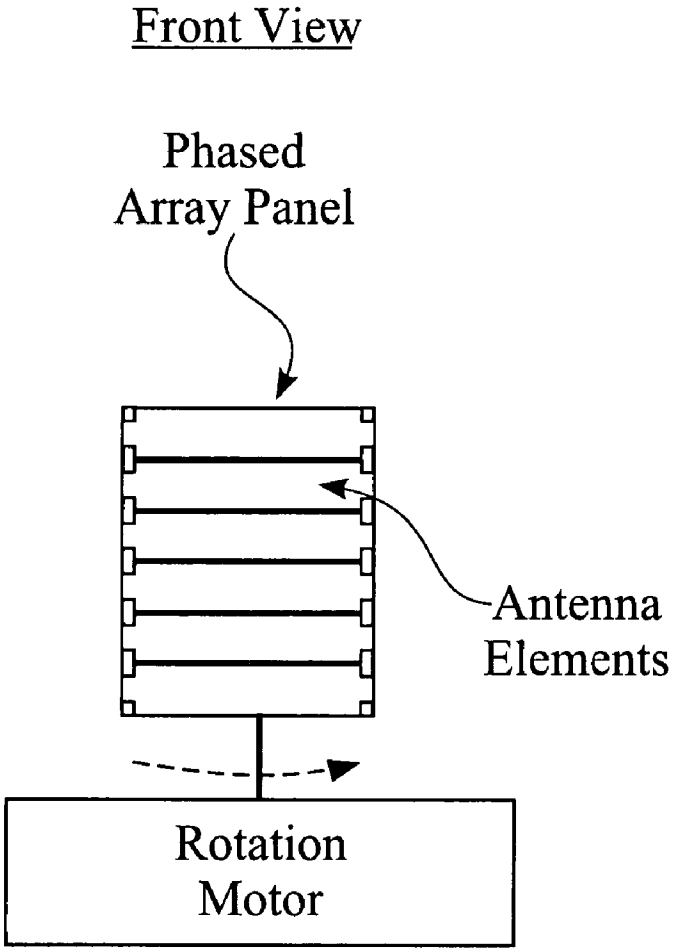

FIG. 25 and FIG. 26 show respective front and side views of a rotating 1-D electronically steered phased array antenna system.

Figure 28:
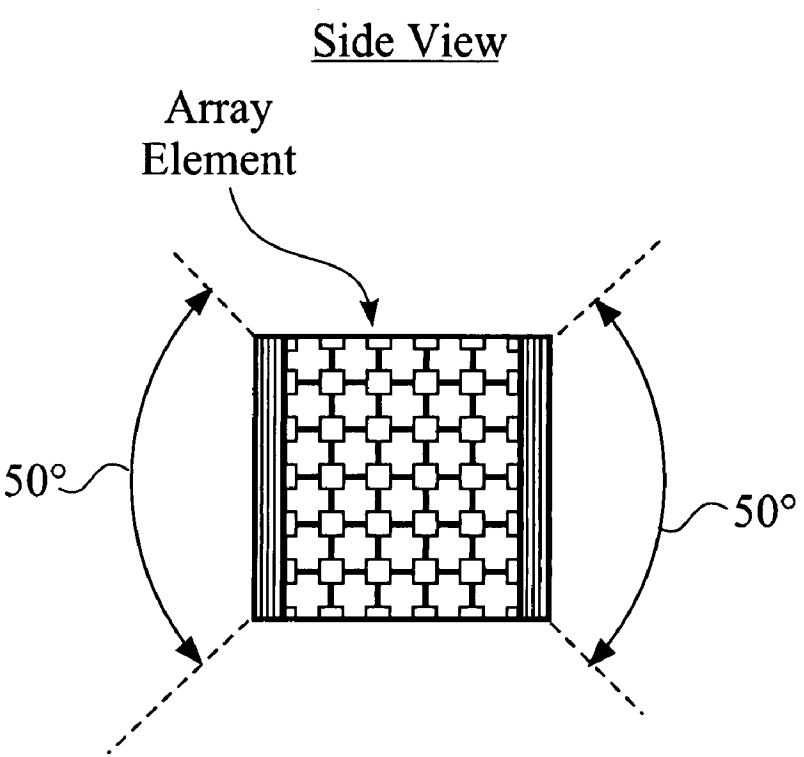
Figure 27:
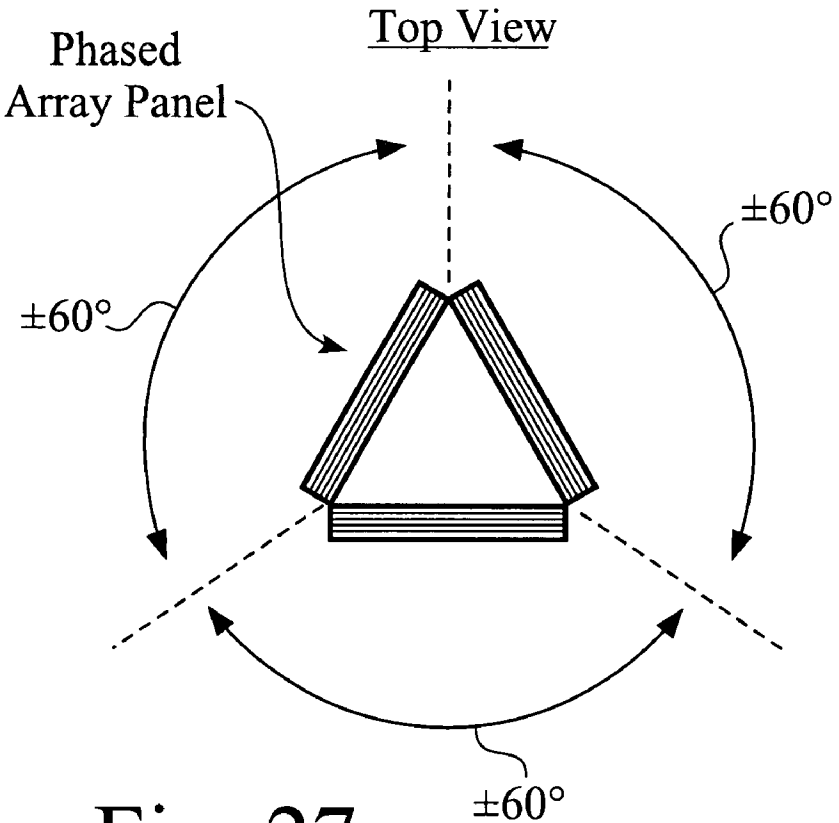

FIG. 27 and FIG. 28 show respective top and side views of an electronically steered 2-D three panel phased array that provides coverage of 360 degrees of azimuth and 50 degrees of elevation.

Figure 30:
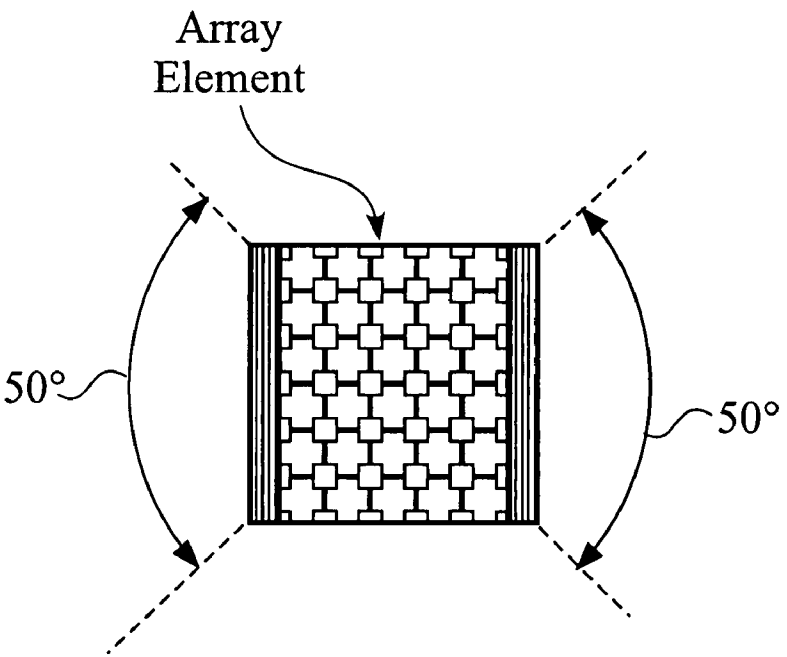
Figure 29:
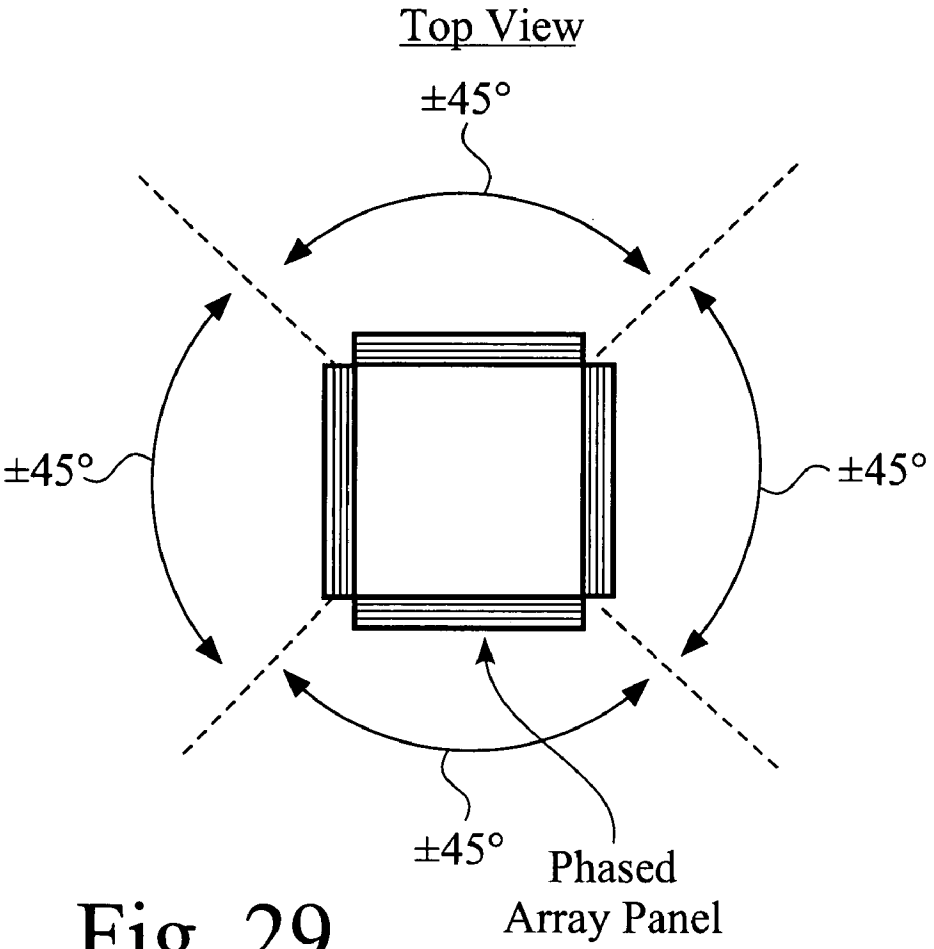

FIG. 29 and FIG. 30 show respective top and side views of an alternate electronically steered 2-D four panel phased array that provides coverage of 360 degrees of azimuth and 50 degrees of elevation.

Figure 32:
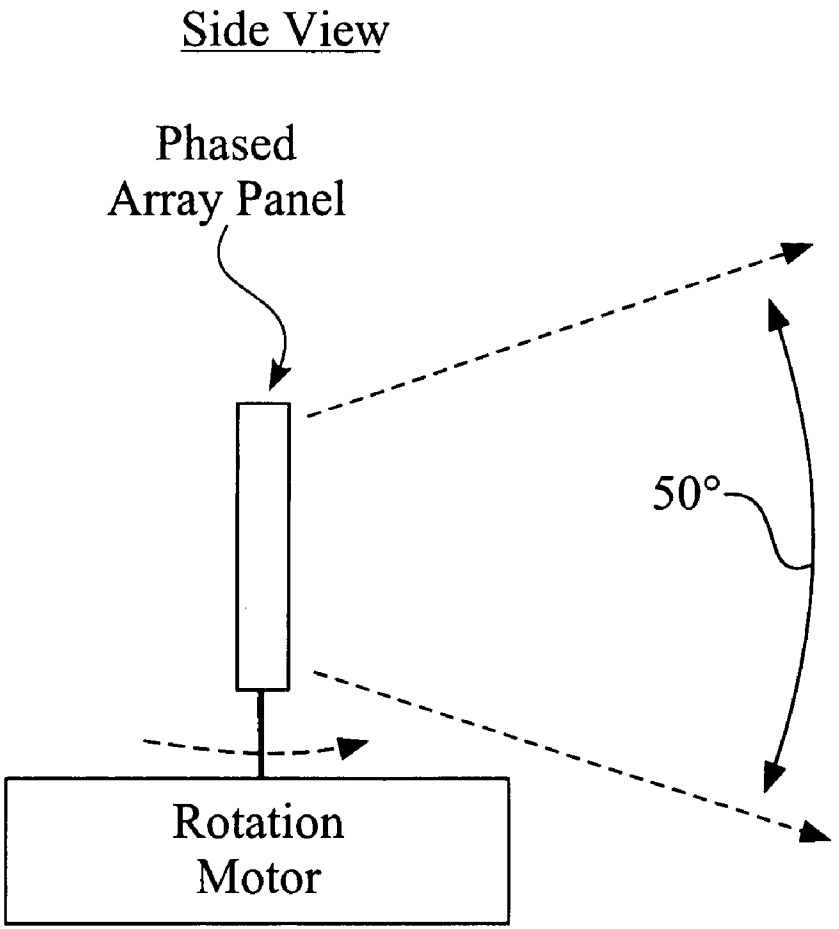
Figure 31:
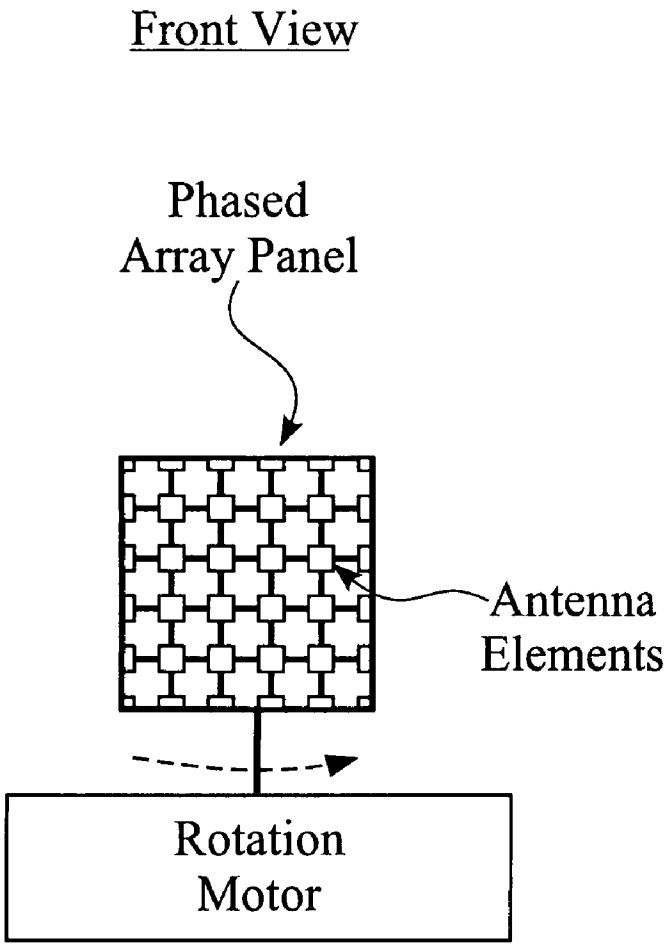

FIG. 31 and FIG. 32 provide respective front and side views of a rotating 2-D electronically steered phased array system.

Figure 33:
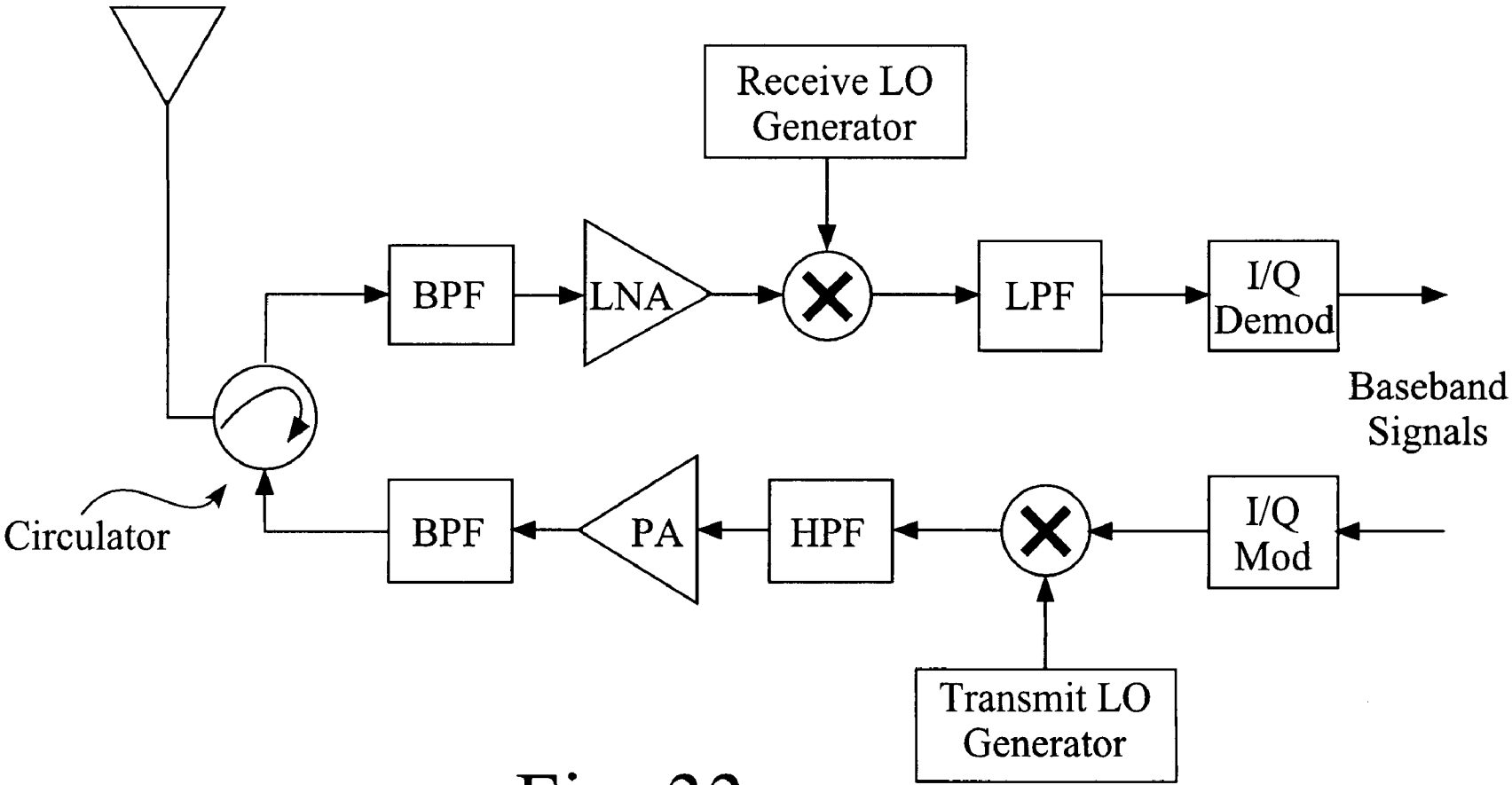

FIG. 33 is a functional block diagram of an exemplary CPE transceiver in one embodiment of the invention.

Figure 34:
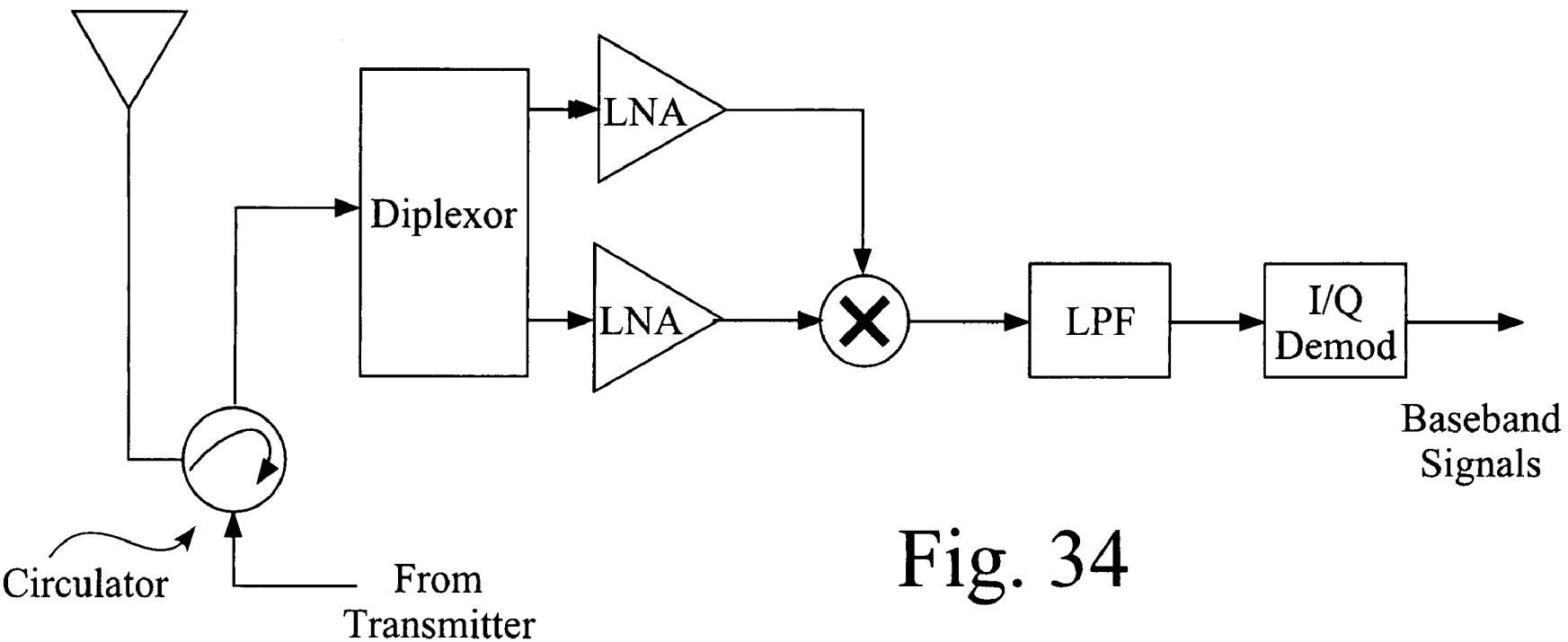

FIG. 34 shows an exemplary schematic receiver structure for using a continuous wave (CW) signal, with filtering of received LO.

Figure 35:
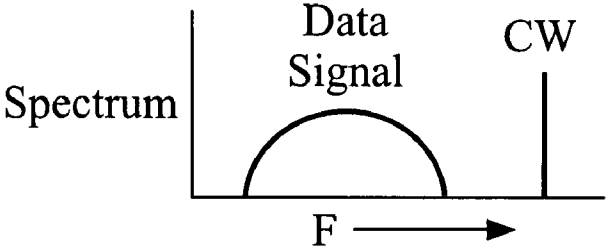

FIG. 35 shows exemplary spectrums for a data signal and continuous wave signal associated with the receiver structure shown in FIG. 34.

Figure 36:
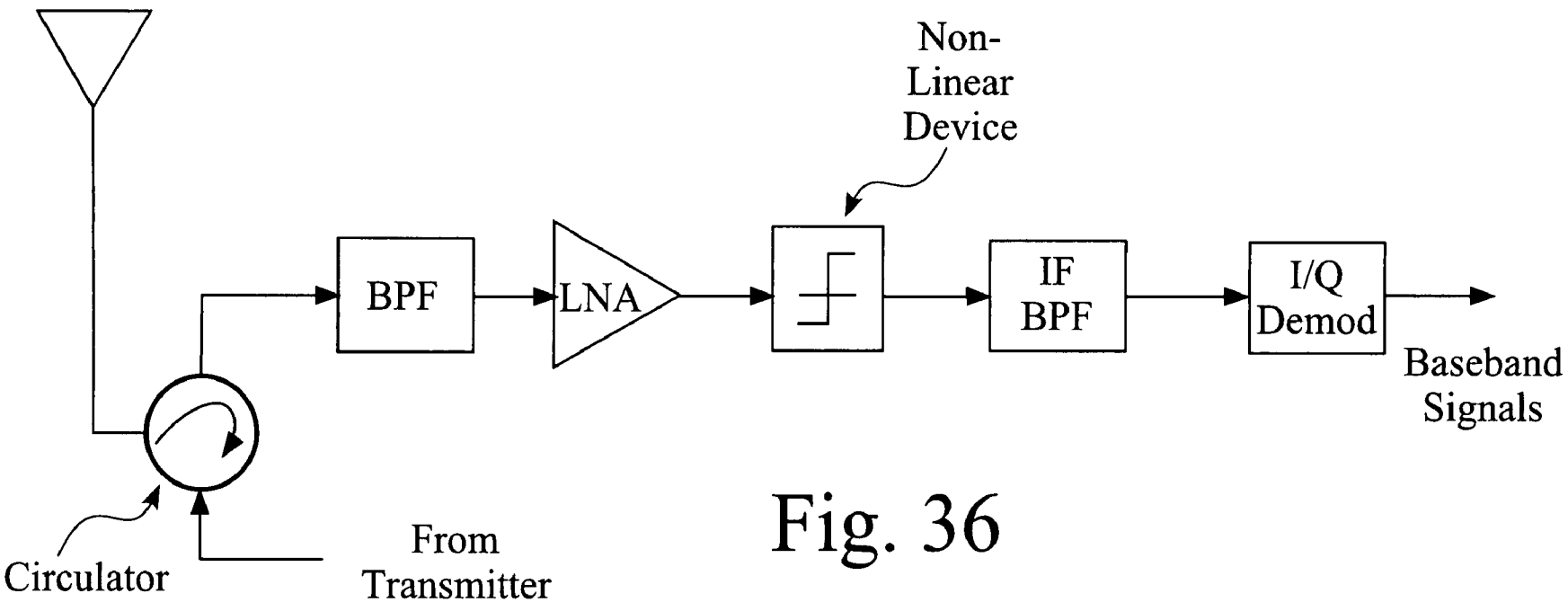

FIG. 36 shows an alternate schematic receiver structure for using a continuous wave (CW) signal, directly using received LO.

Figure 37:
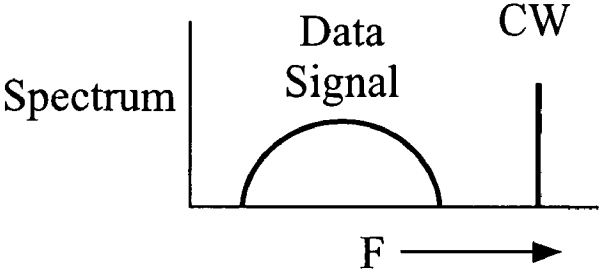

FIG. 37 shows exemplary spectrums for a data signal and continuous wave signal associated with the alternate receiver structure shown in FIG. 36.

Figures 38, 39:
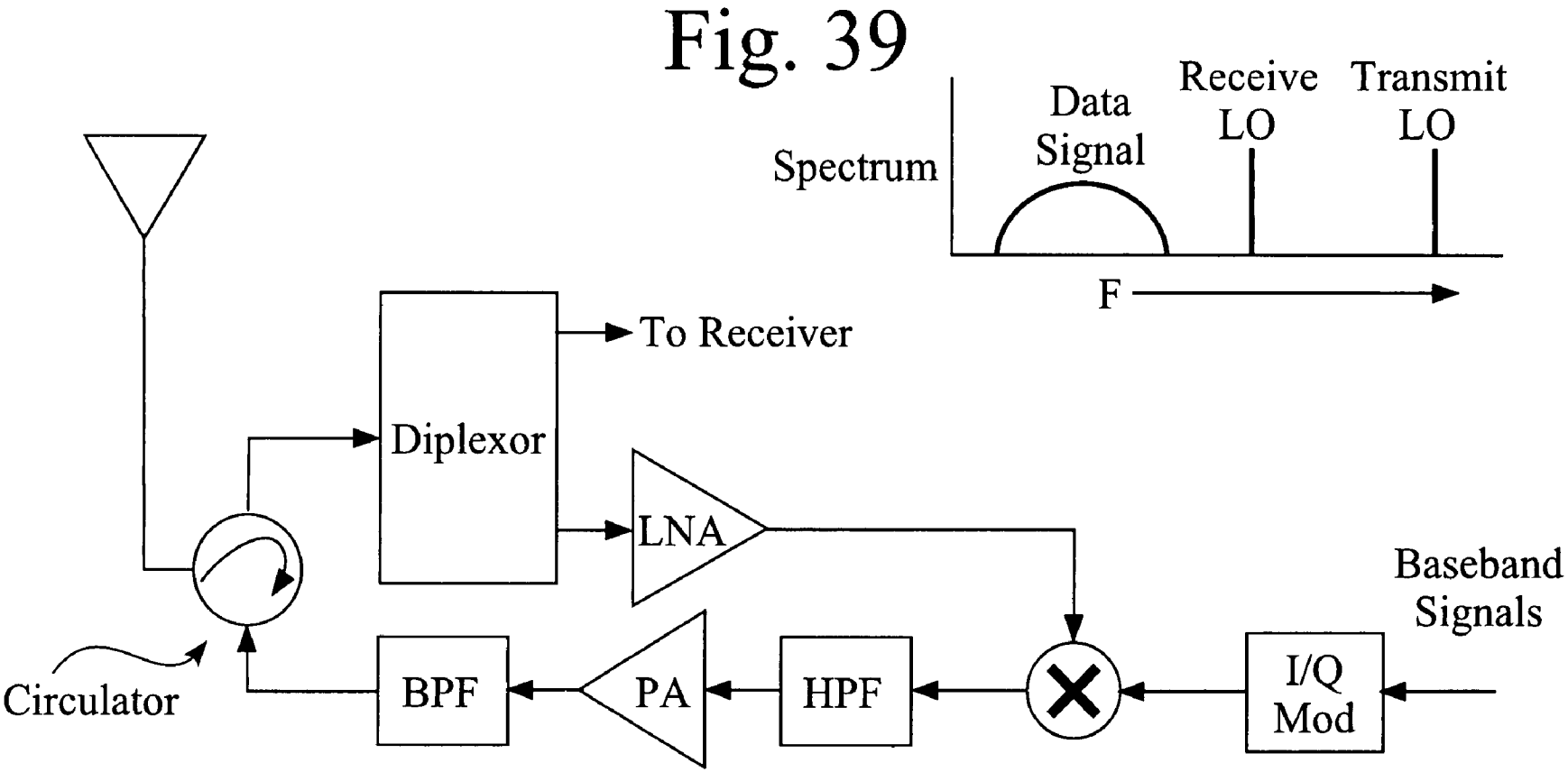

FIG. 38 shows an exemplary schematic transmitter structure for using a continuous wave (CW) signal as a LO for a CPE transmitter.

FIG. 39 shows exemplary spectrums for a data signal, receive LO signal and transmit LO signal associated with the transmitter shown in FIG. 38.

Figure 40:
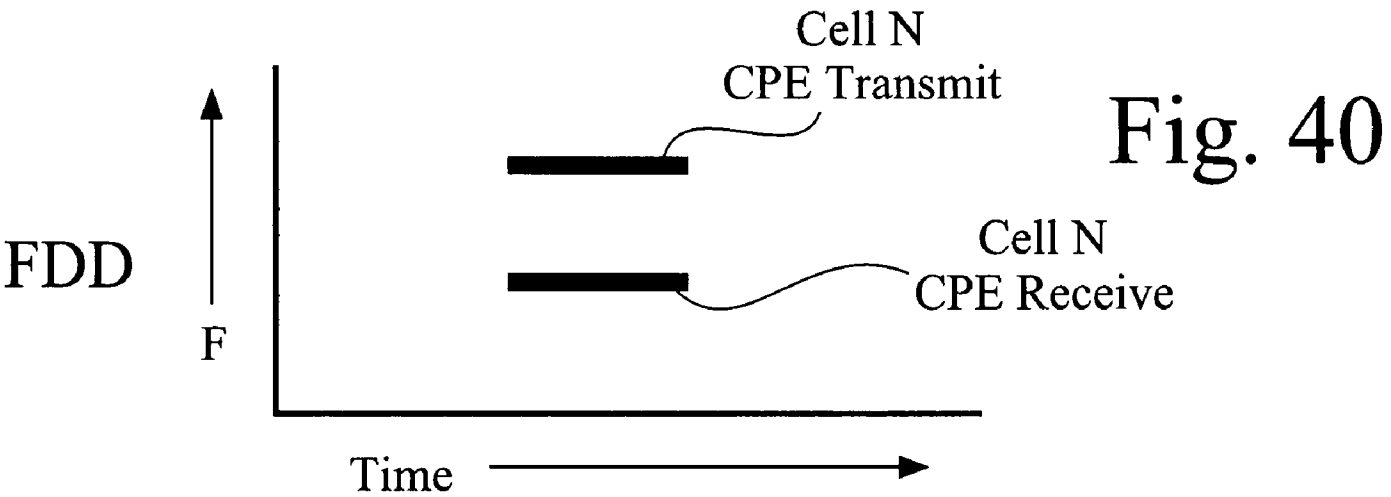

FIG. 40 shows exemplary cell duplex transmission and reception for a system using frequency division duplex (FDD).

Figure 41:
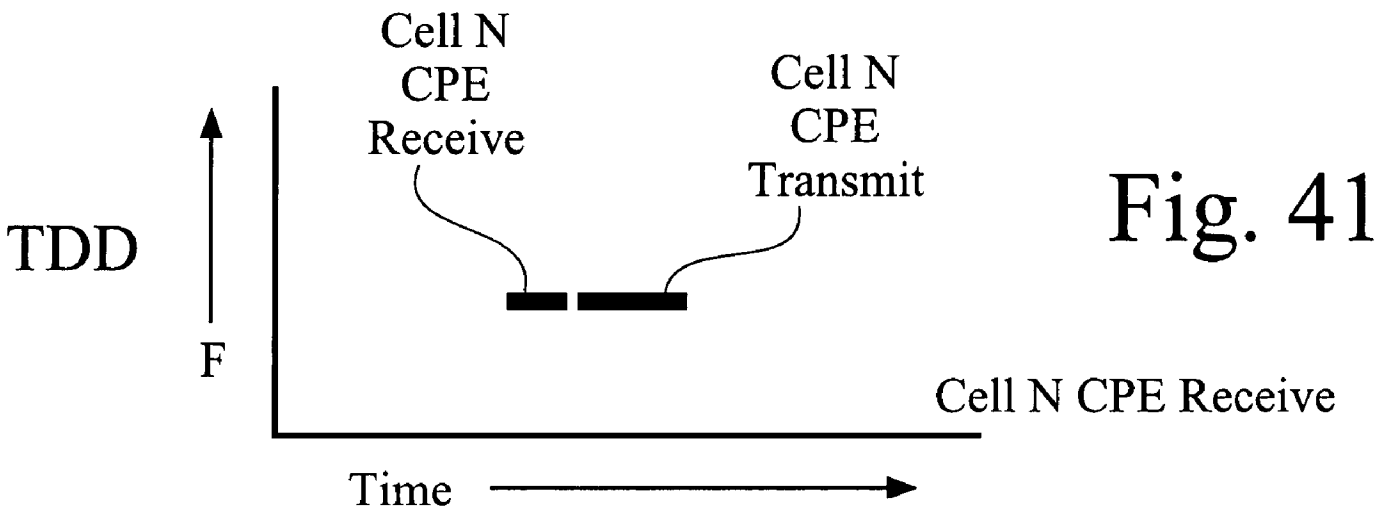

FIG. 41 shows exemplary cell duplex transmission and reception for an alternate system using time division duplex (TDD).

Figure 42:
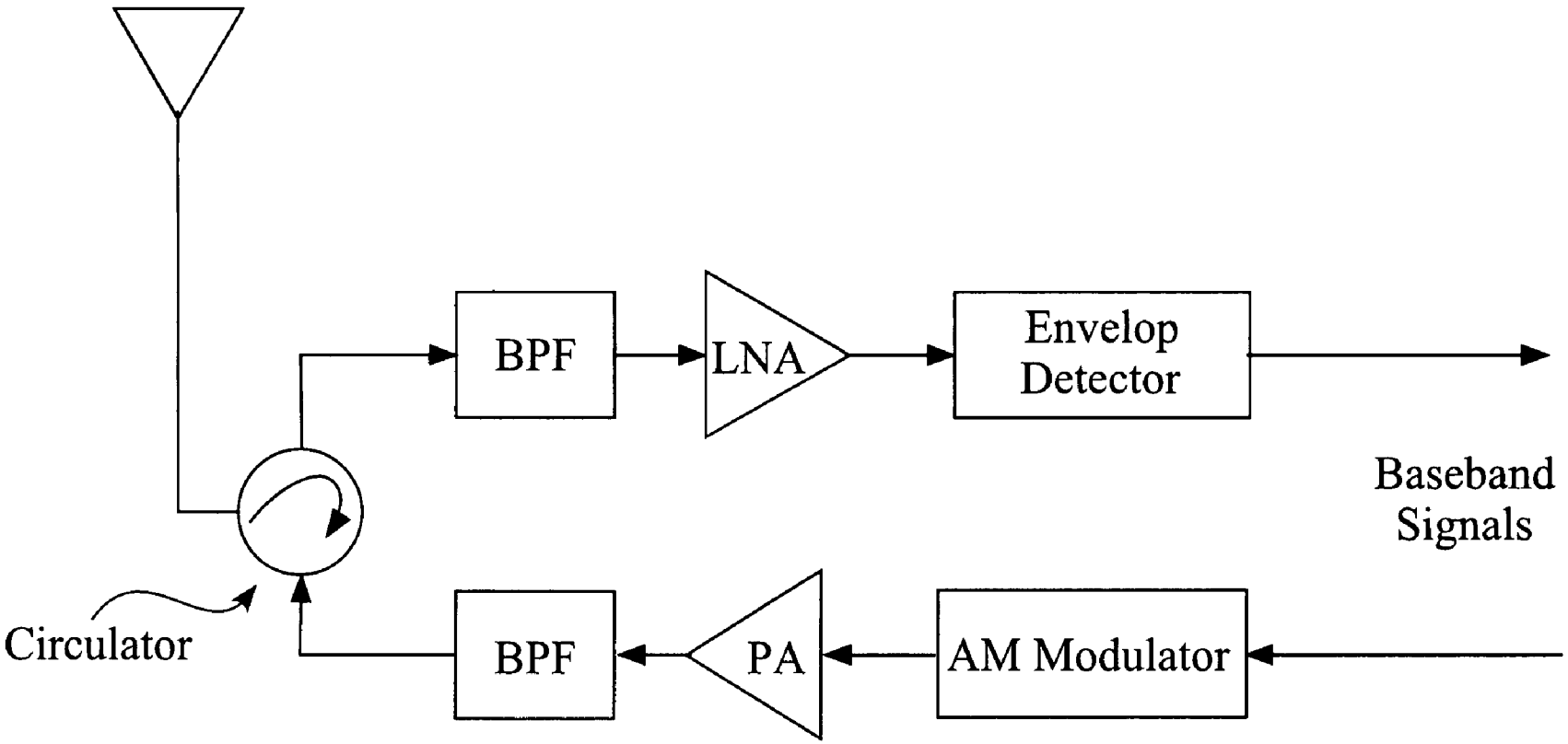

FIG. 42 is an exemplary schematic depiction of an exemplary AM transceiver structure that amplitude modulates (AM) the baseband signals on a MMW signal at the transmitter, and AM demodulates them at the receiver using an envelope detector.

Figure 43:
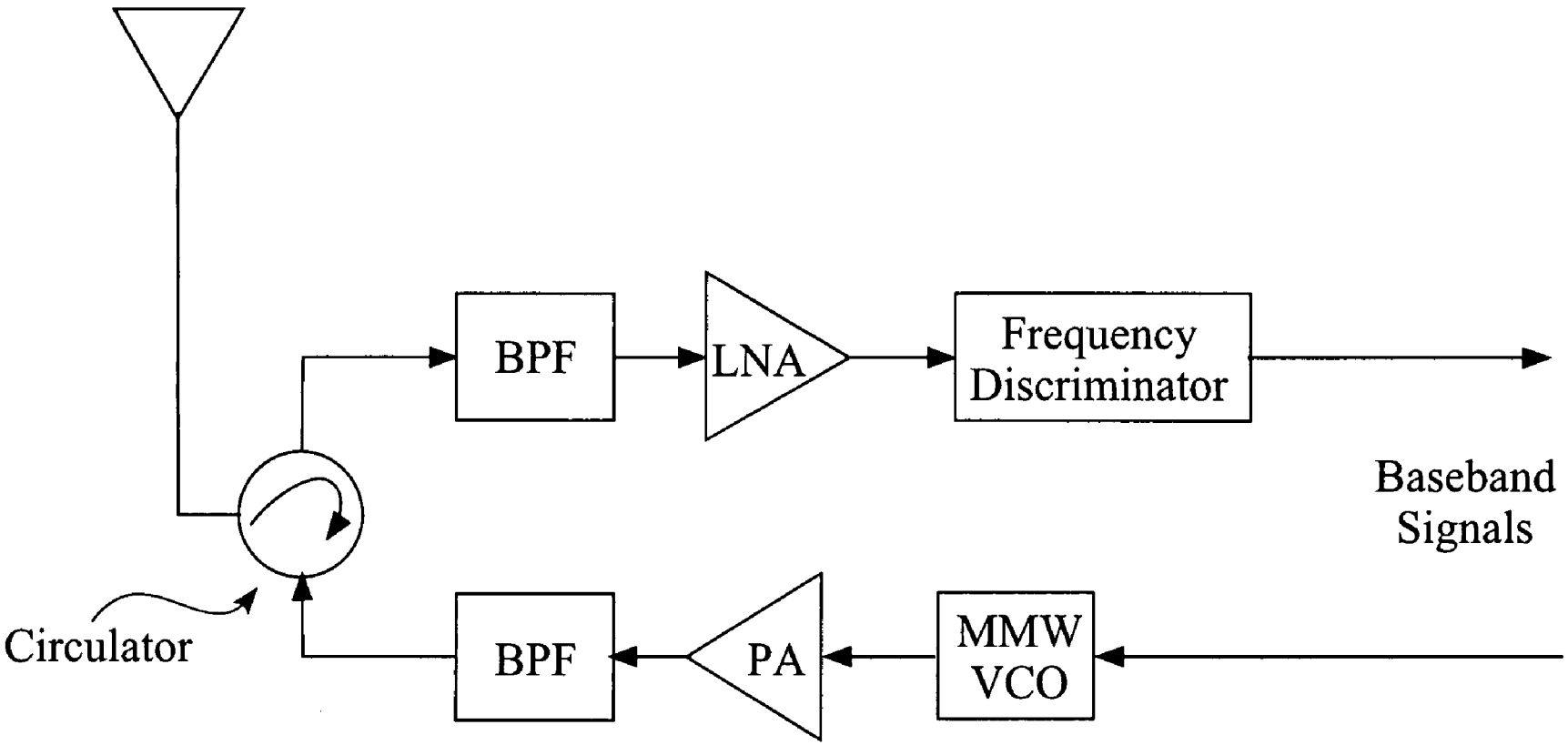
Figure 44:
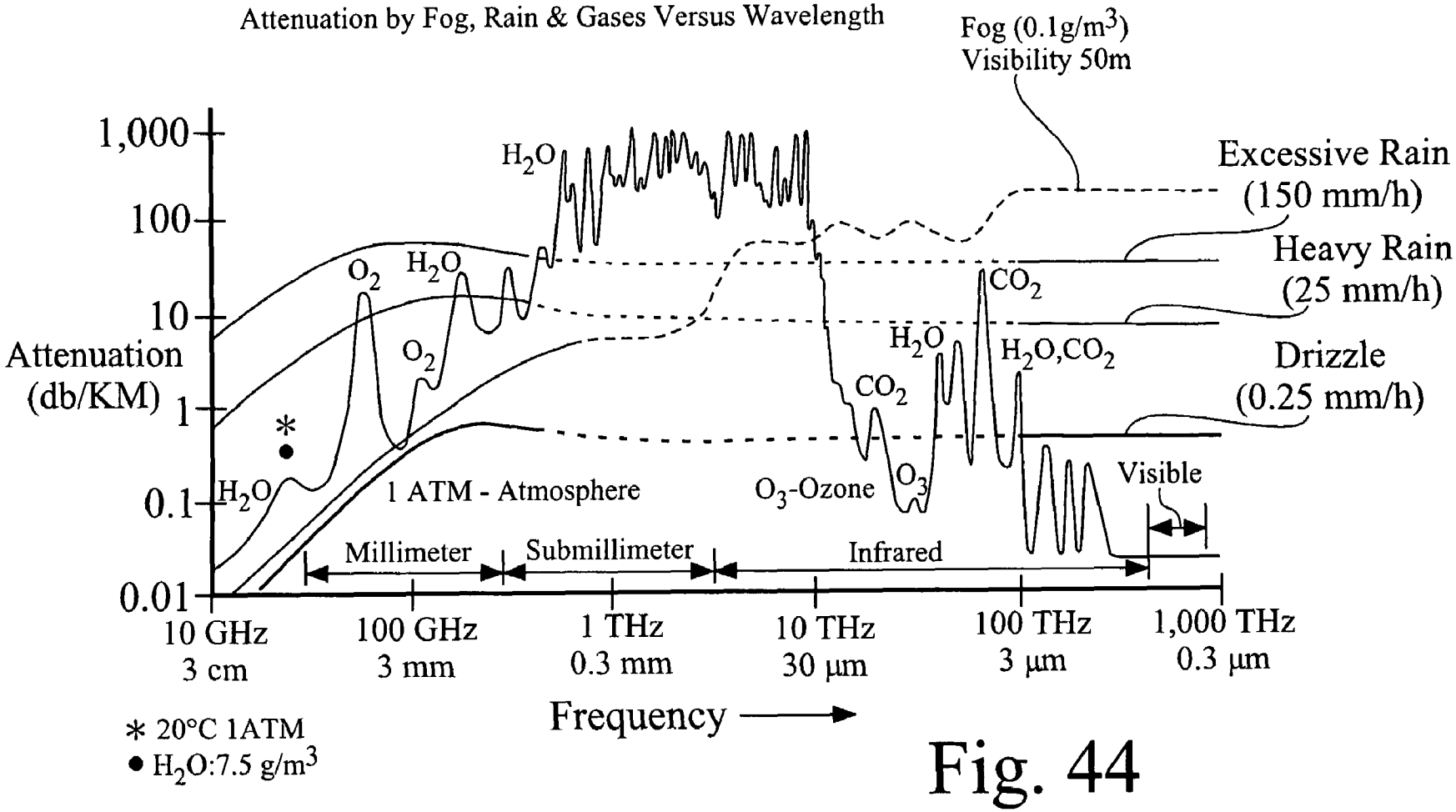
Figure 45:
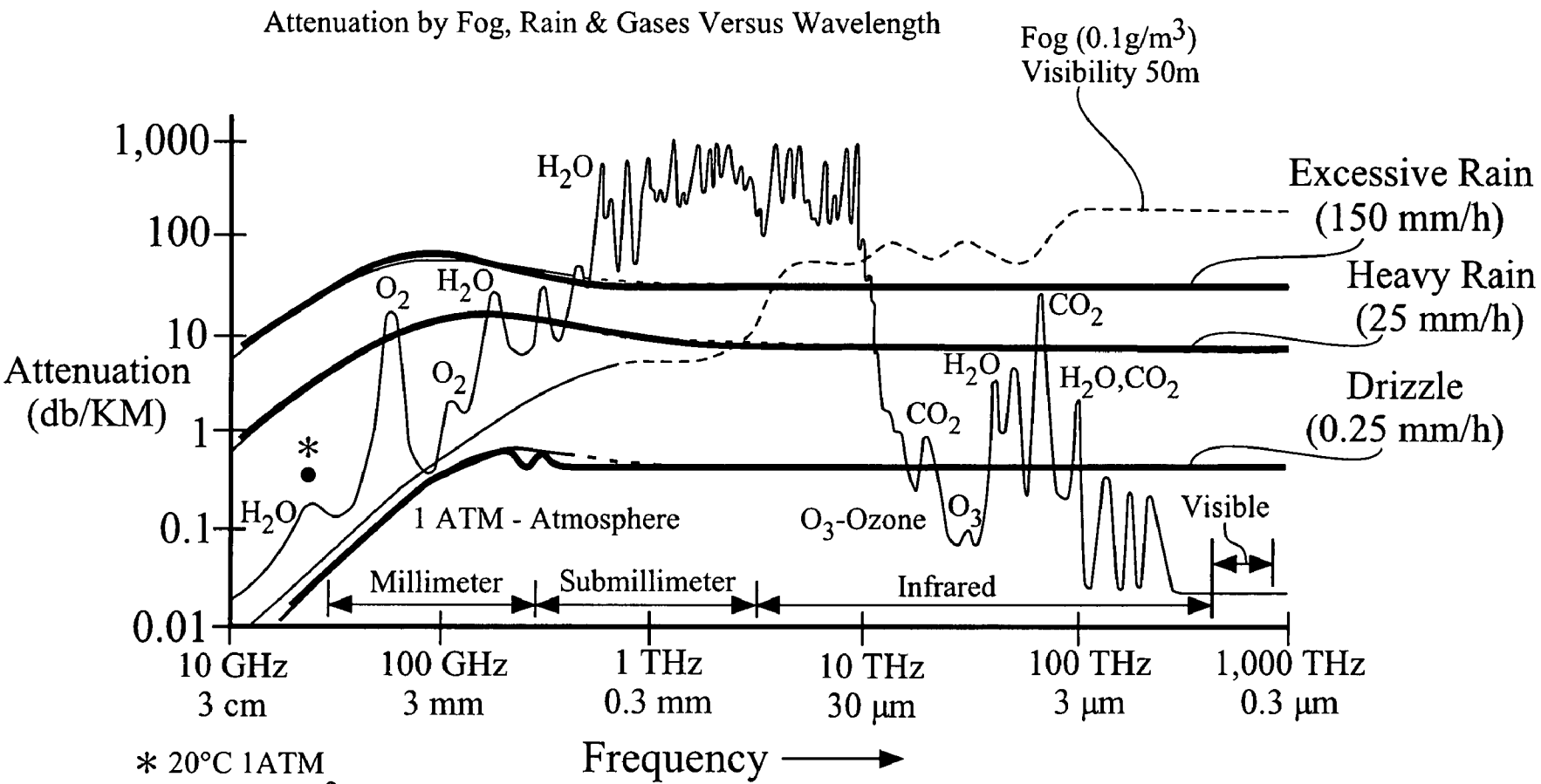
Figure 46:
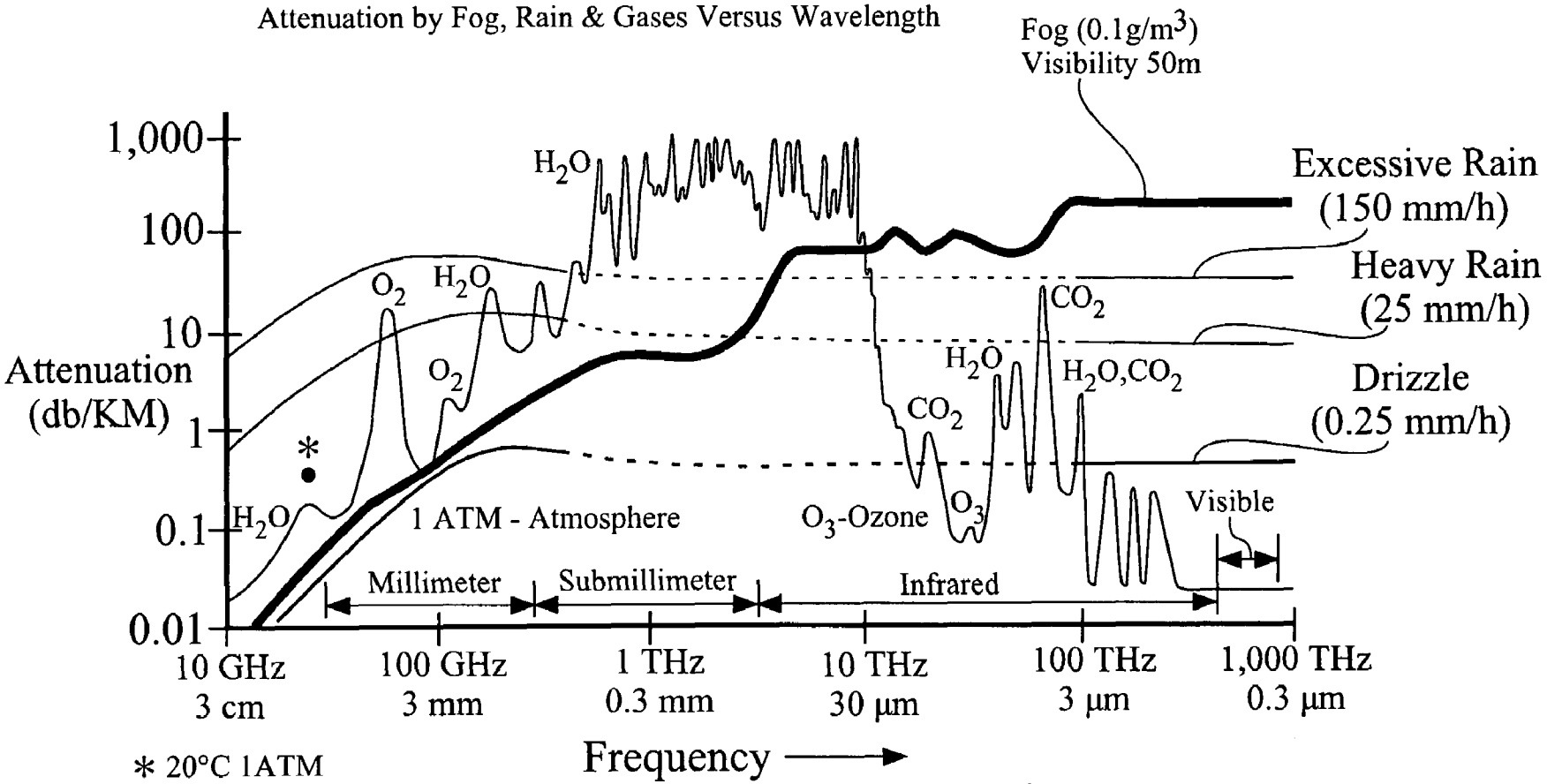
Figure 47:
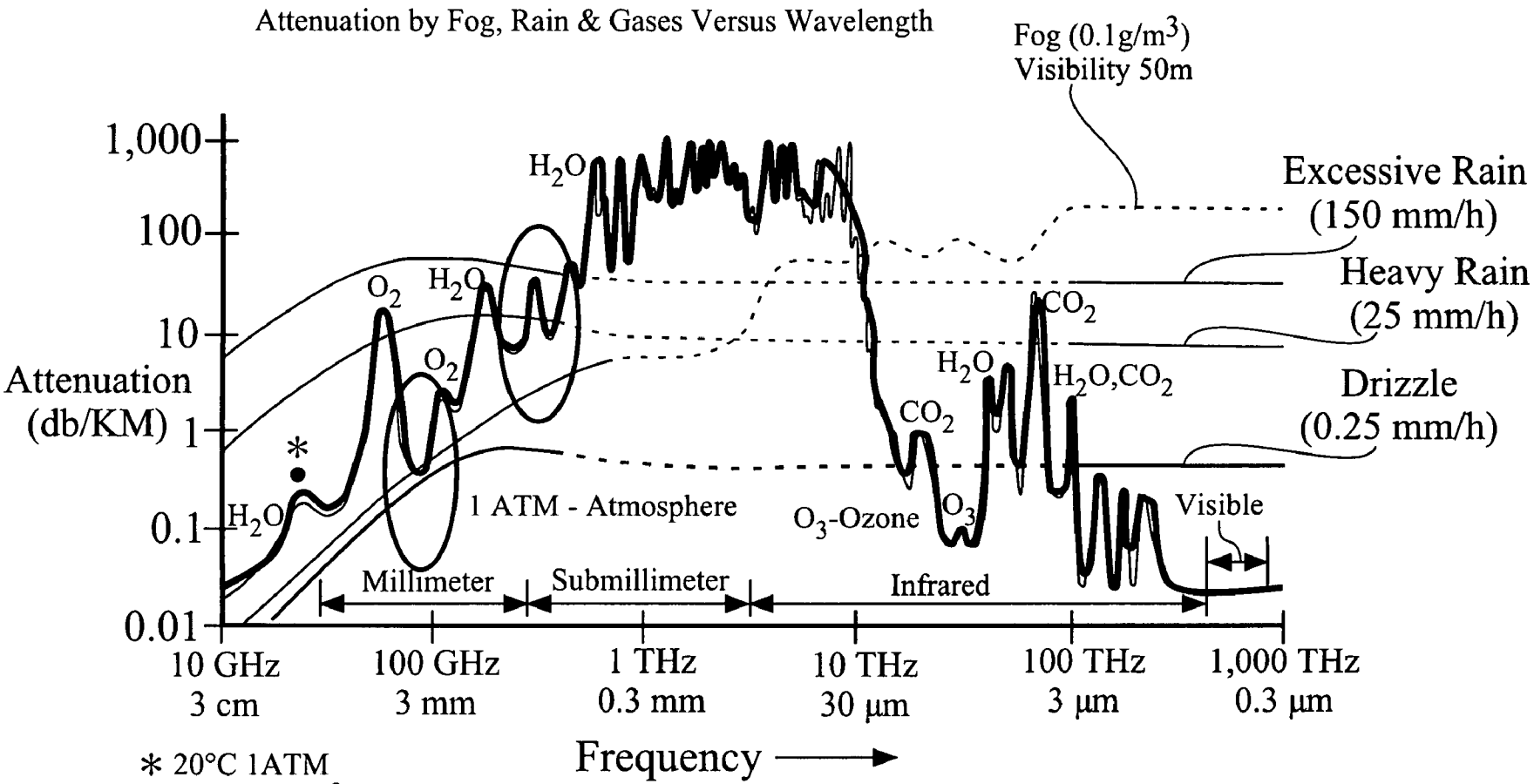

FIG. 43 is a schematic view of an exemplary FM transceiver structure that frequency modulates (FM) baseband data signals on a MMW carrier at the transmitter and FM demodulates the signals at the receiver using a frequency discriminator.

FIGS. 44 through 47 provide charts showing exemplary signal attenuation, such as by fog, rain and gases, as a function of frequency or wavelength.

A DETAILED DESCRIPTION OF PREFERRED & ALTERNATIVE EMBODIMENTS

Figure 1:
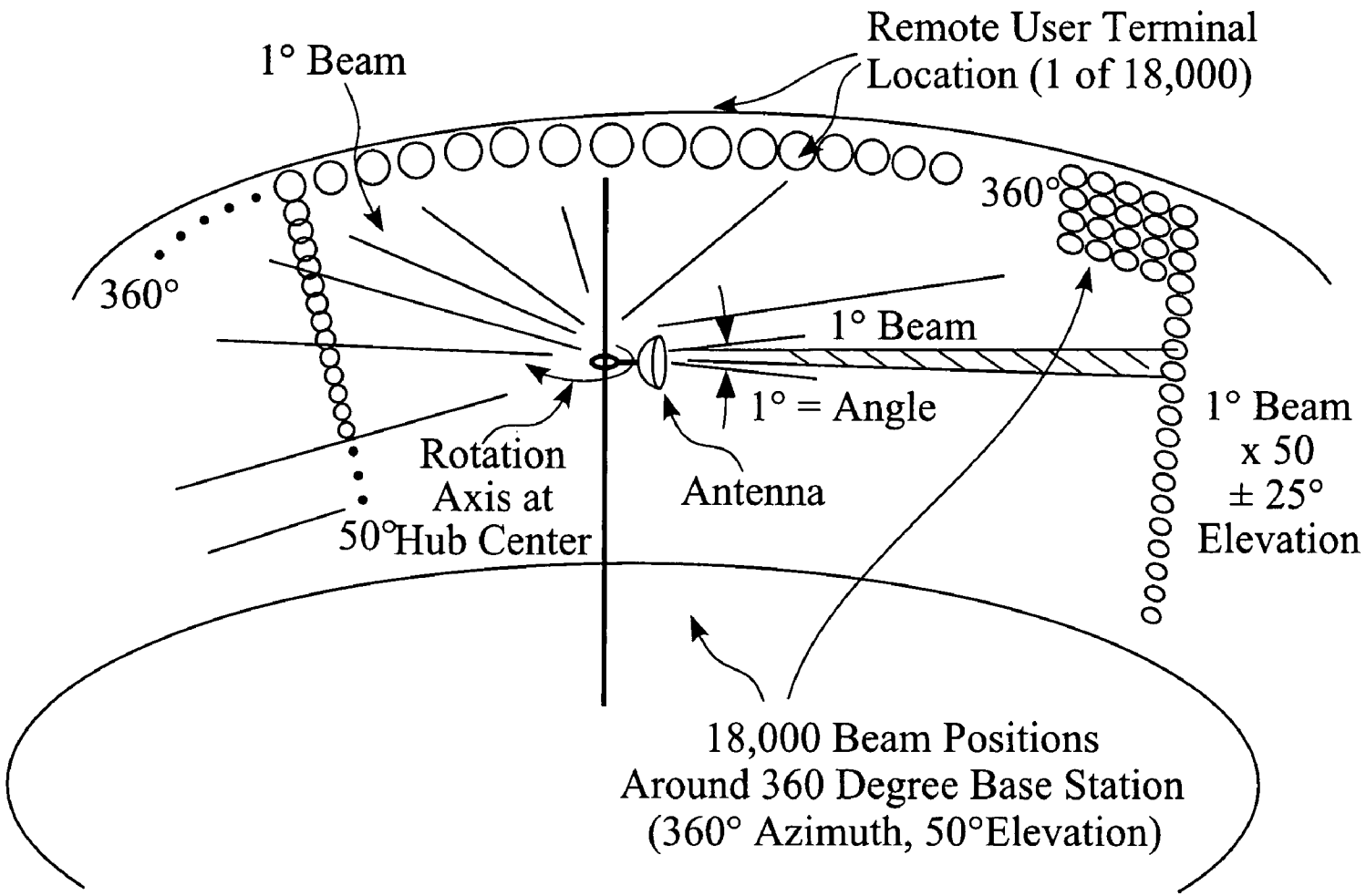

FIG. 1 depicts one particular embodiment of the invention, which comprises a central base station antenna installed on a generally vertical mast that includes a rotating beacon. In this embodiment, the antenna is generally located in the center of a cell. The antenna and a radio are mounted on the mast. The axis of rotation is aligned through the center of the radio hub.

In one embodiment of the invention, the antenna transmits and/or receives millimeter wave signals, and operates at a beamwidth of about one degree. This configuration creates approximately 18,000 beam positions around the base station (360 degrees of arc of azimuth). In this embodiment, the antenna is pointed at an elevation of fifty degrees. The elevation angle may be adjusted up or down by approximately twenty-five degrees. Consequently, this single rotating beacon can provide telecommunications services to approximately 18,000 remote user terminals.

Figure 2:
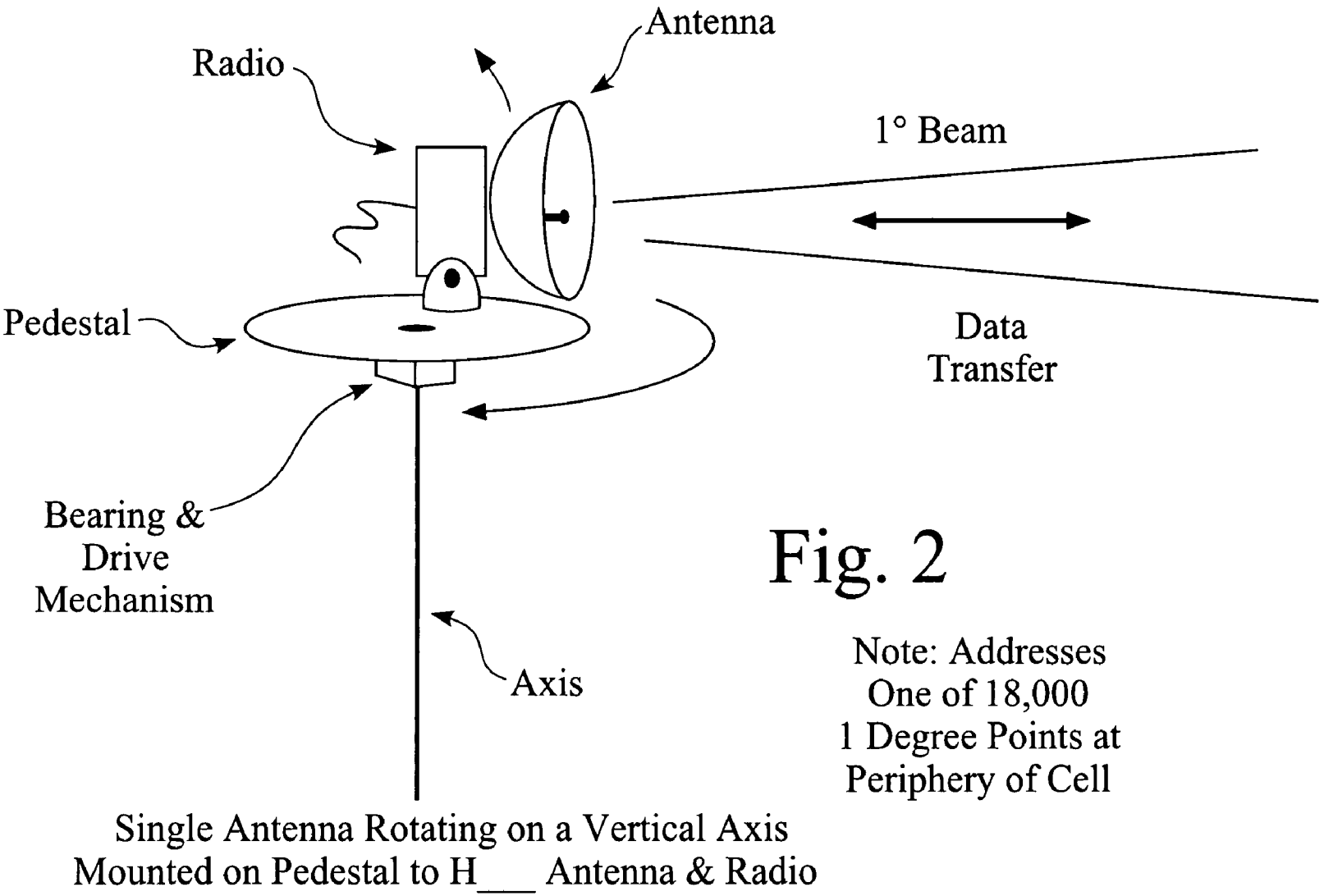

FIG. 2 provides a detailed view of the rotating beacon. A pedestal is installed at the top of a pole, mast or some other suitable structure. The pedestal is supported by a bearing, which, in turn, is coupled to a drive mechanism. In one embodiment of the invention, the rotation speed of the mirror may range from 500 to 15,000 revolutions per minute.

Figure 3:
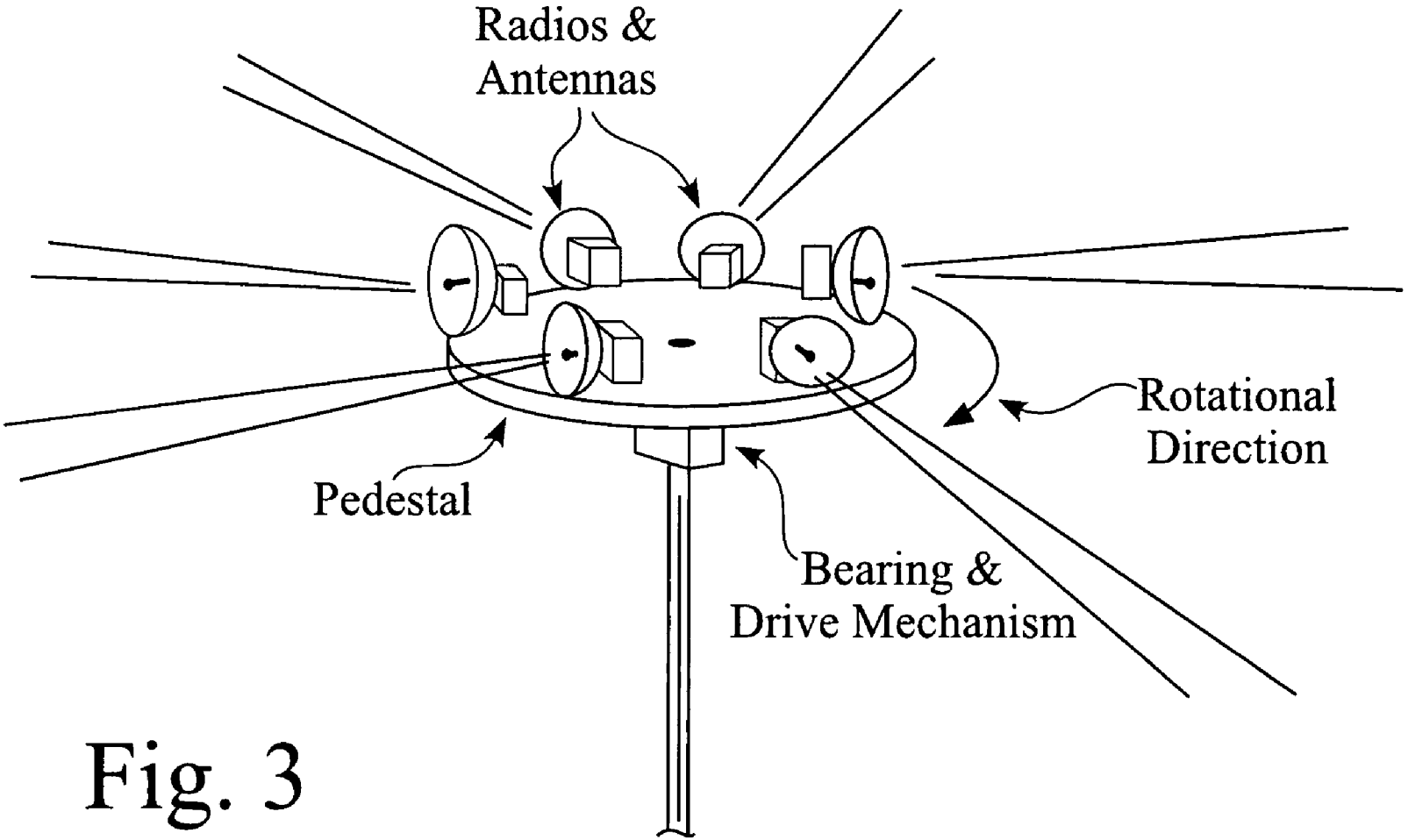

FIG. 3 portrays a beacon comprising multiple radios and antennas installed on the top of the rotating pedestal. The pedestal may be rotated or revolved by a conventional electric motor, or by any other suitable device. The pedestal or platform may be supported by a bearing that is coupled to the mast.

Figure 5:
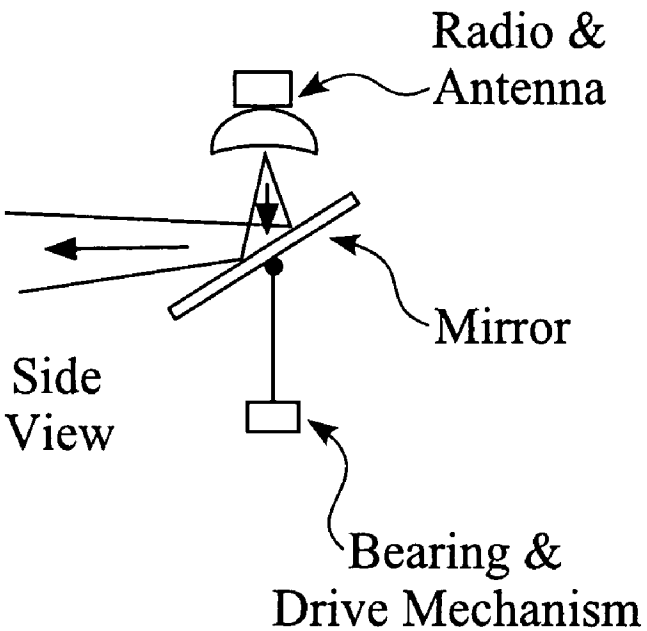
Figure 4:
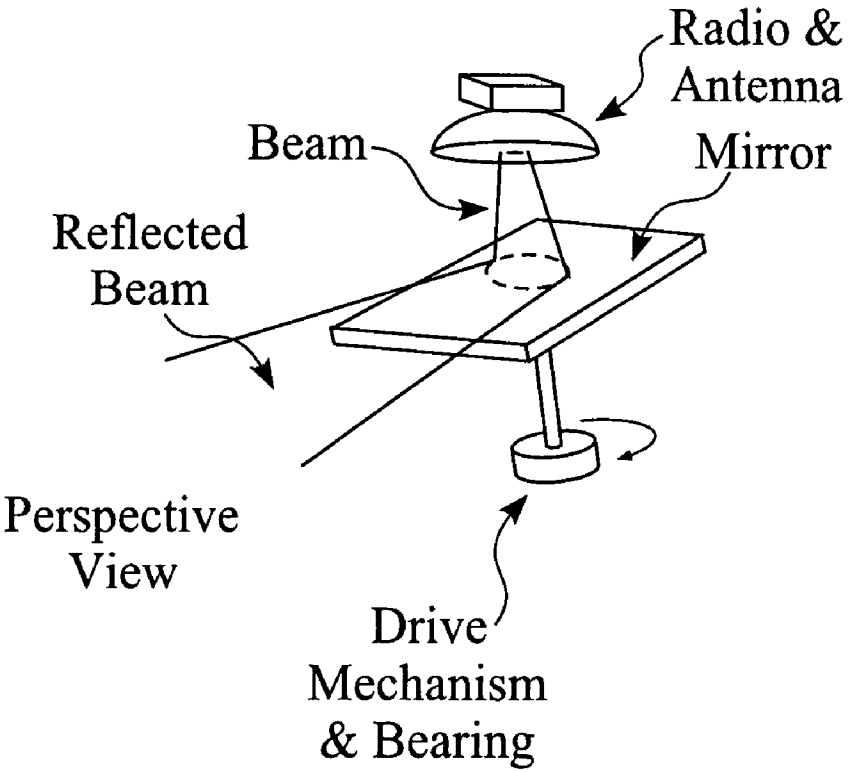

In FIGS. 4 and 5, a fixed radio and antenna together are shown positioned generally above a rotating mirror. This alternative embodiment enables a reflected beam to be directed toward remote terminals. The inclination of the mirror may be varied to change the direction of the reflected beam. In this embodiment, the antenna and radio are physically independent from and are not mechanically coupled to mirror.

Figure 6:
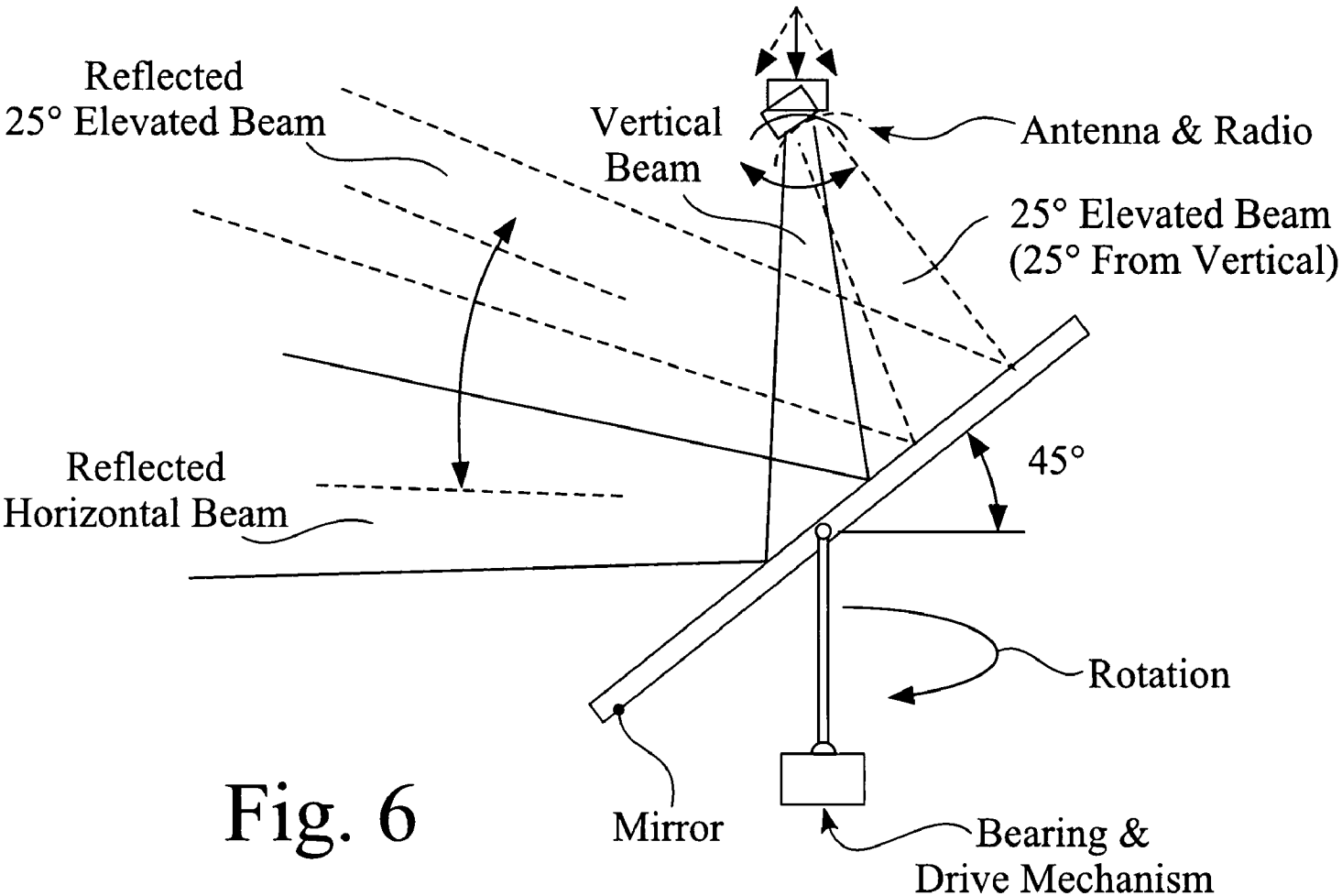

FIG. 6 supplies a more detailed view of the rotating mirror. In this depiction, the beam elevation may be adjusted through a plus or minus twenty-five degree arc.

Figure 7:
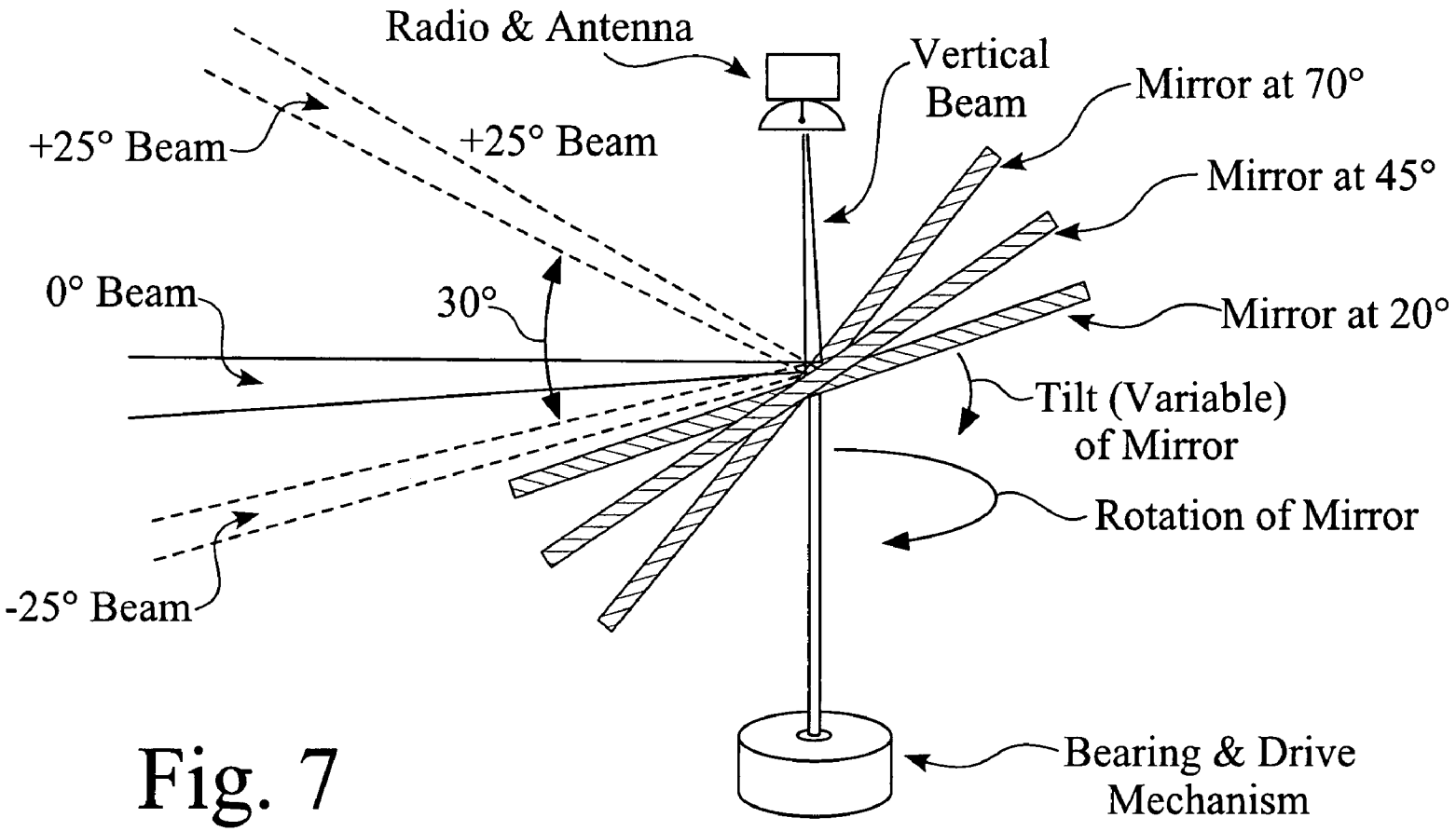

FIG. 7 offers another view of this variable tilt feature, which enables precise control of the elevation of the reflected beam.

Figure 9:
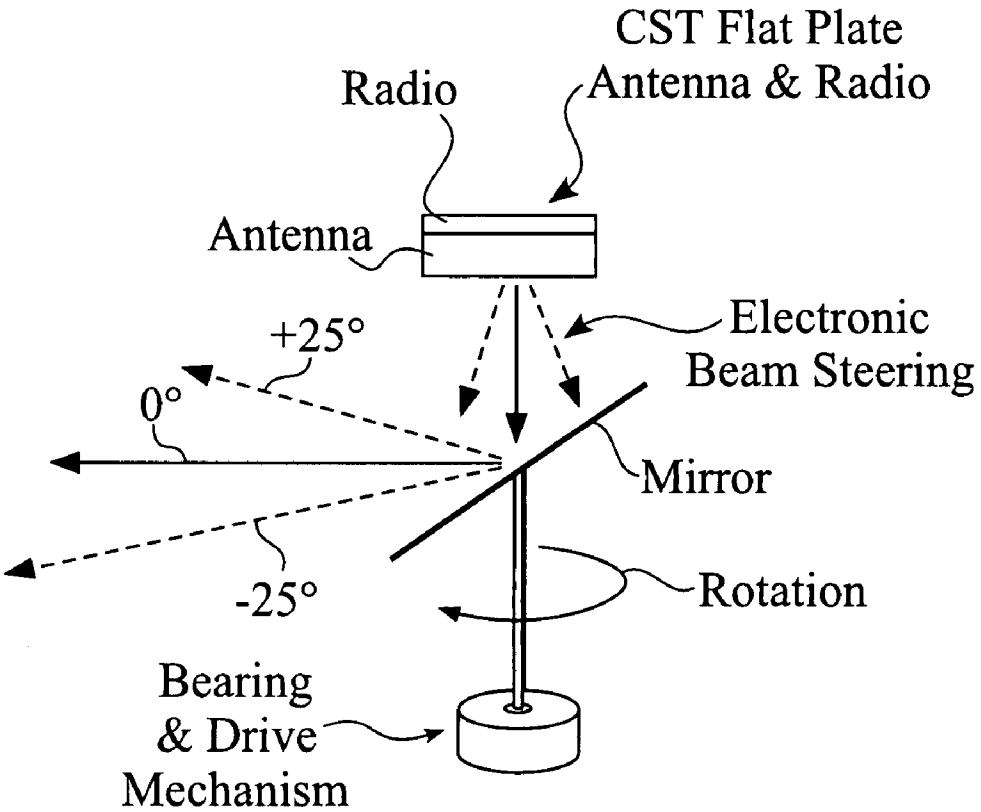
Figure 8:
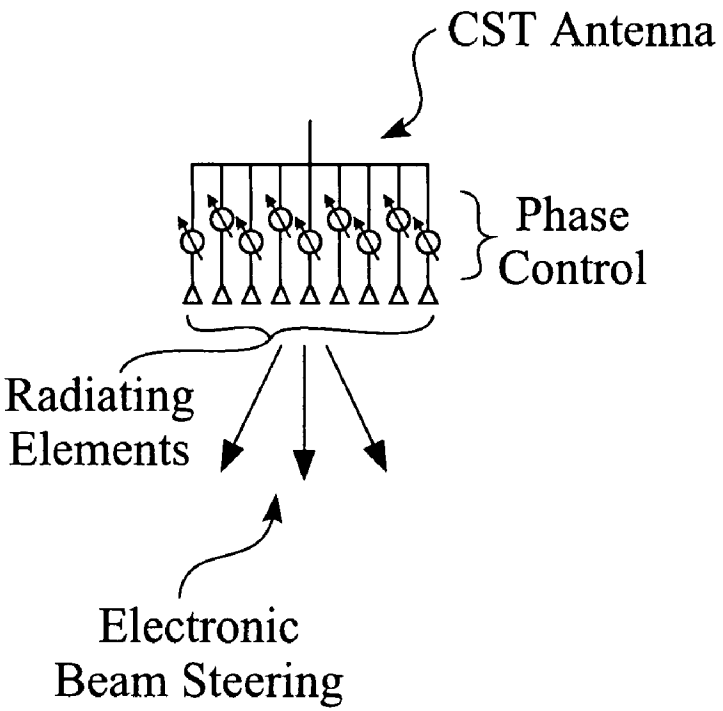

Yet another embodiment of the invention is illustrated in FIGS. 8 and 9. FIG. 8 illustrates an antenna with phase controllers and multiple radiating elements that provide electronic beam steering. FIG. 9 combines the electronic beam steering feature shown in FIG. 8 with a flat plate antenna and radio and a rotating mirror. In this embodiment, a Continuous Traverse Stub (CTS) antenna is utilized. This type of antenna is sold by ThinKom Solutions of Torrance, Calif.

Figure 10:
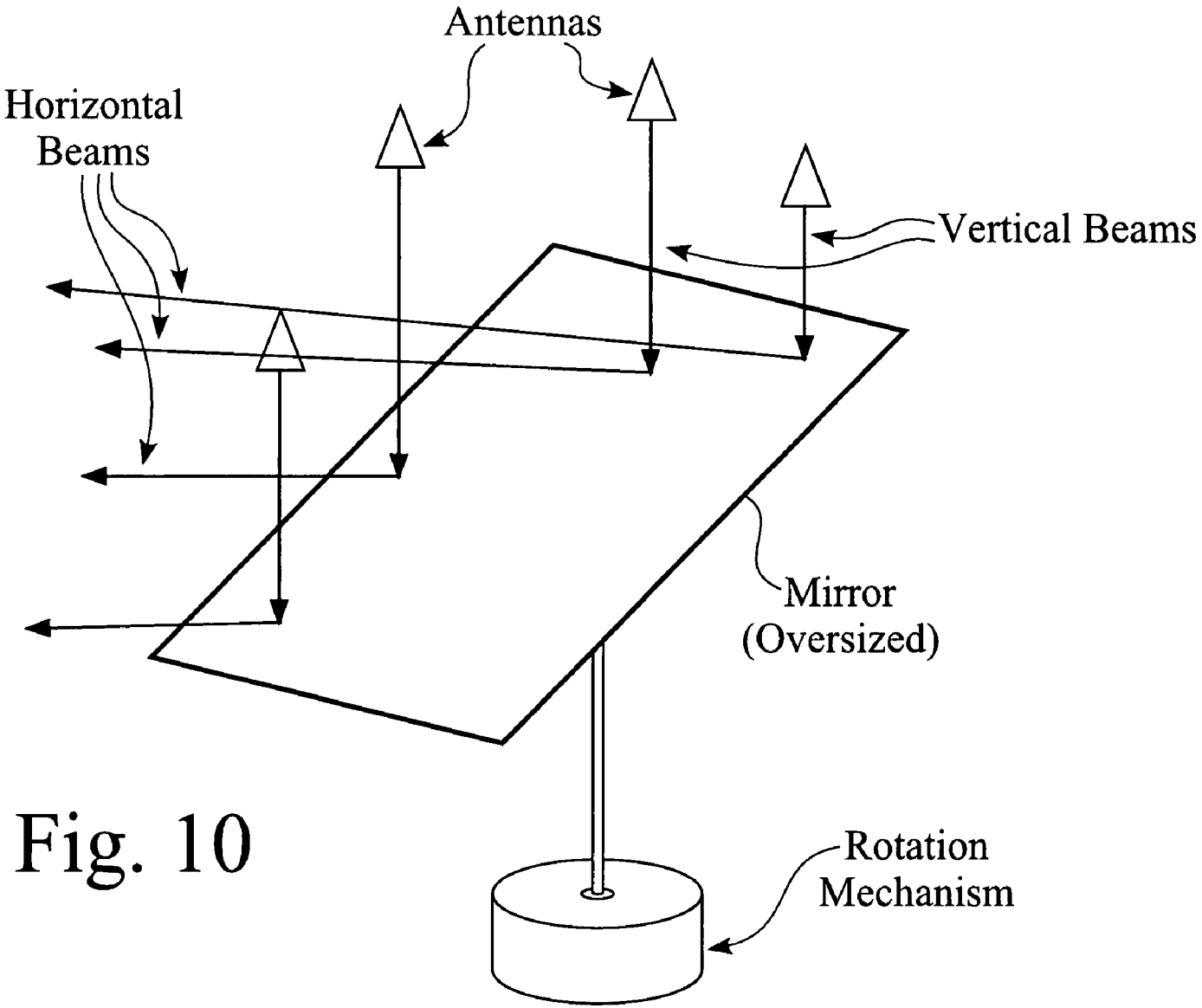

FIG. 10 depicts an antenna with an oversized mirror. A number of antennas positioned generally above the spinning mirror produce a number of corresponding reflected beams.

Figure 11:
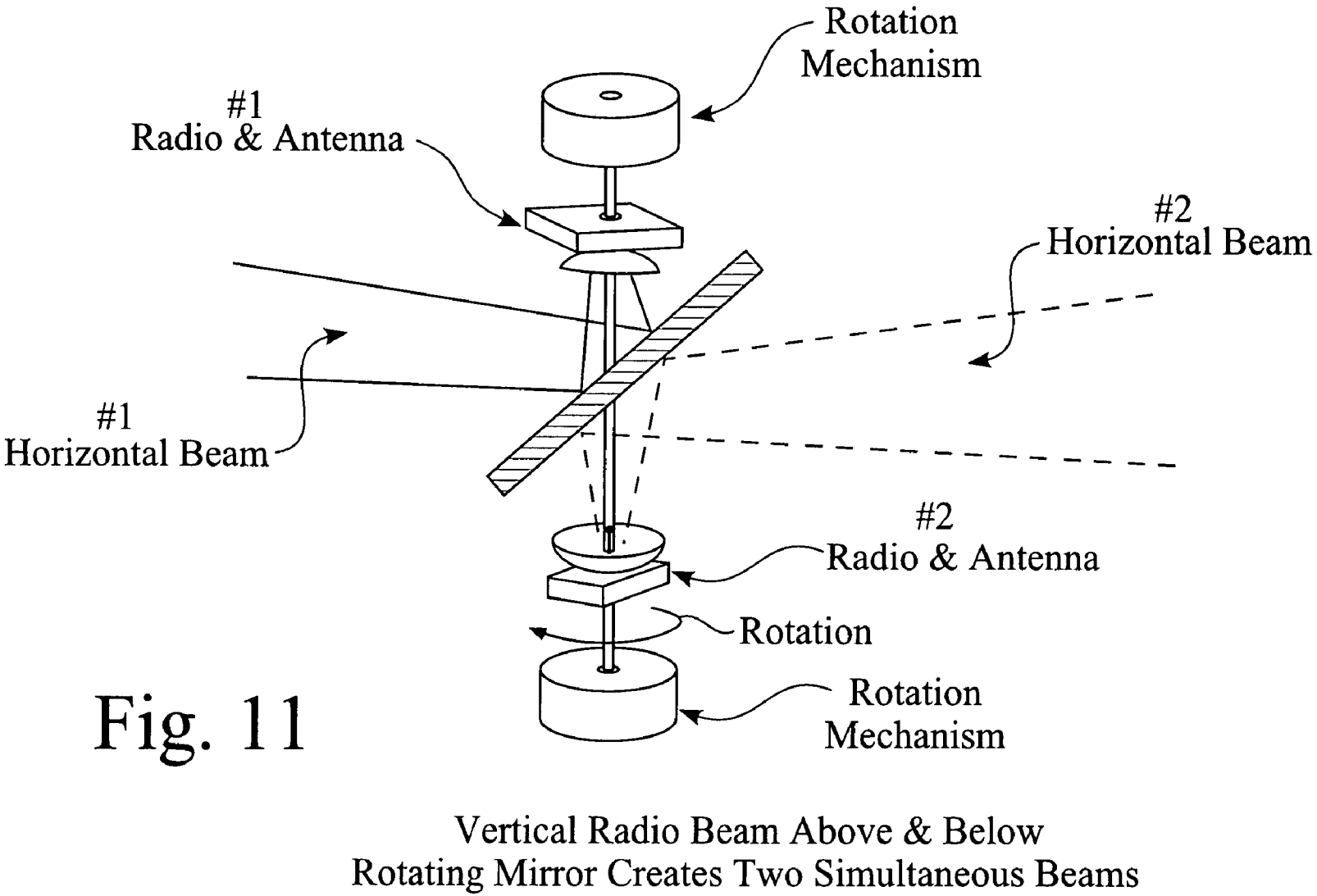

FIG. 11 supplies a view of an alternative embodiment that incorporates a radio and an antenna both above and below a rotating mirror. This embodiment generates two sets of reflected beams.

Figure 12:
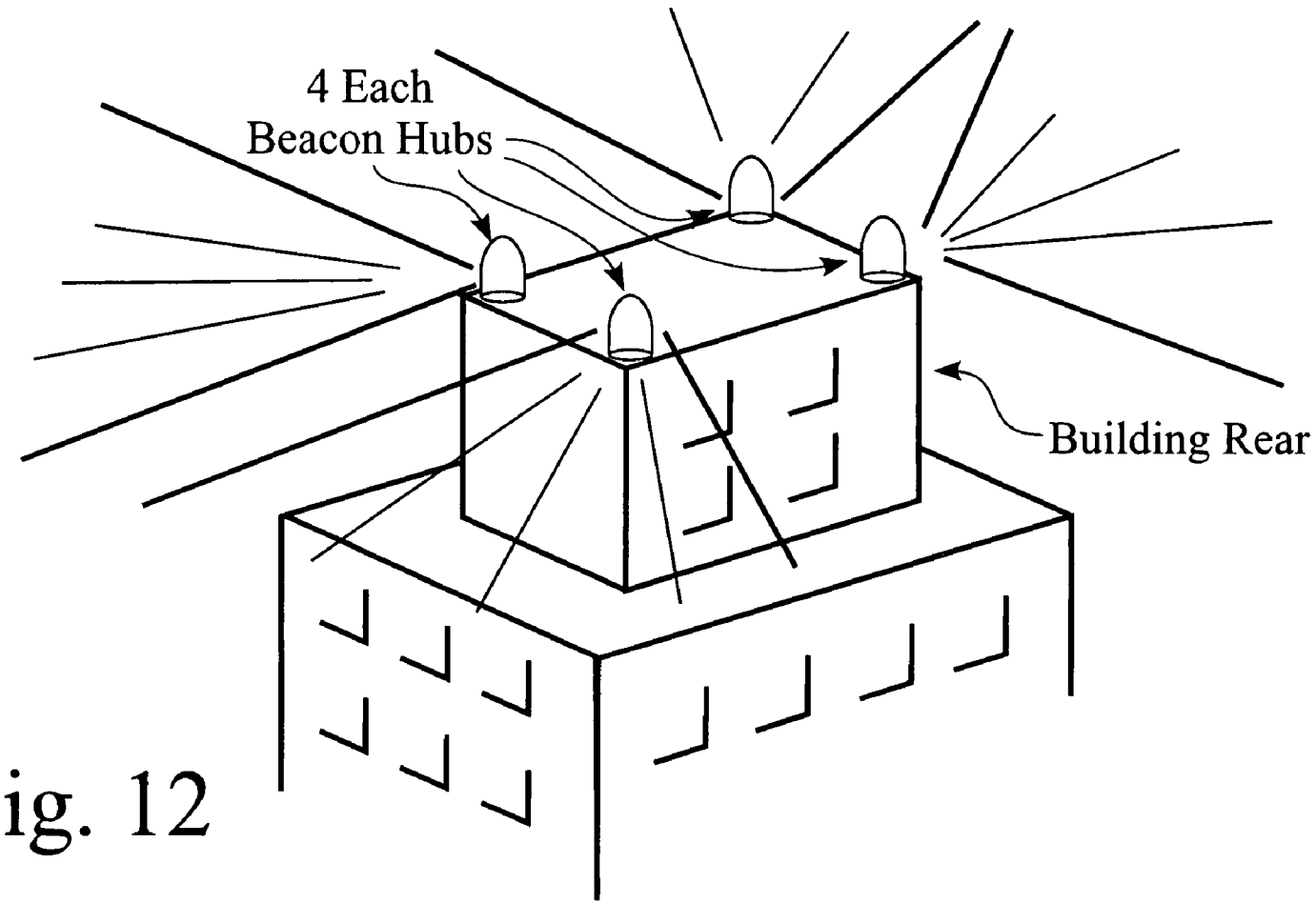

FIG. 12 offers a view of a building with four rotating beacon antennas installed at each of the four corners of the roof of the building. Each antenna provides communications coverage to a portion of the cell.

Figure 13:
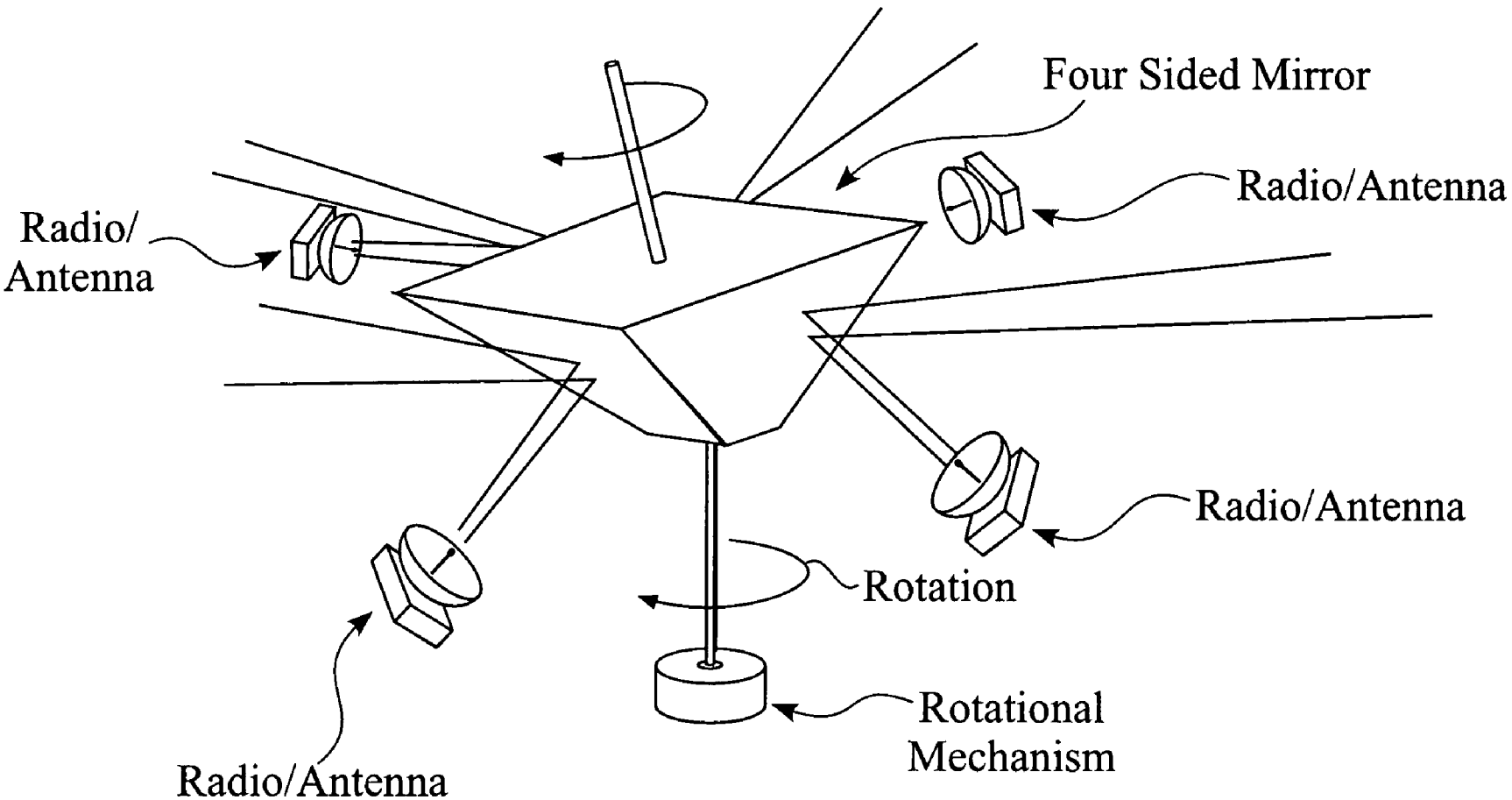

FIG. 13 displays a rotating antenna which is configured with four reflecting sides.

Figure 14:
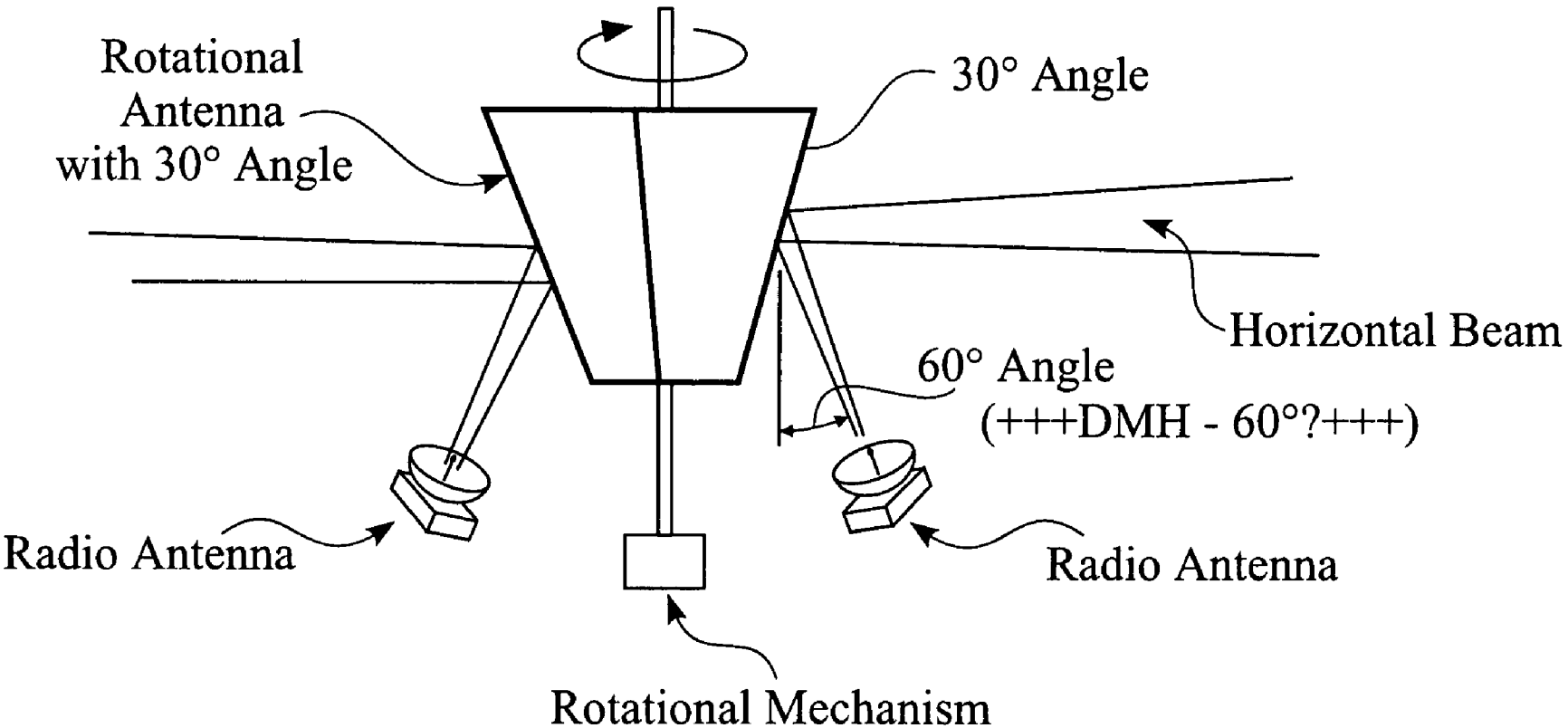

FIG. 14 provides a view of a rotating antenna with a thirty degree mirror and a sixty degree antenna angle.

Figure 15:
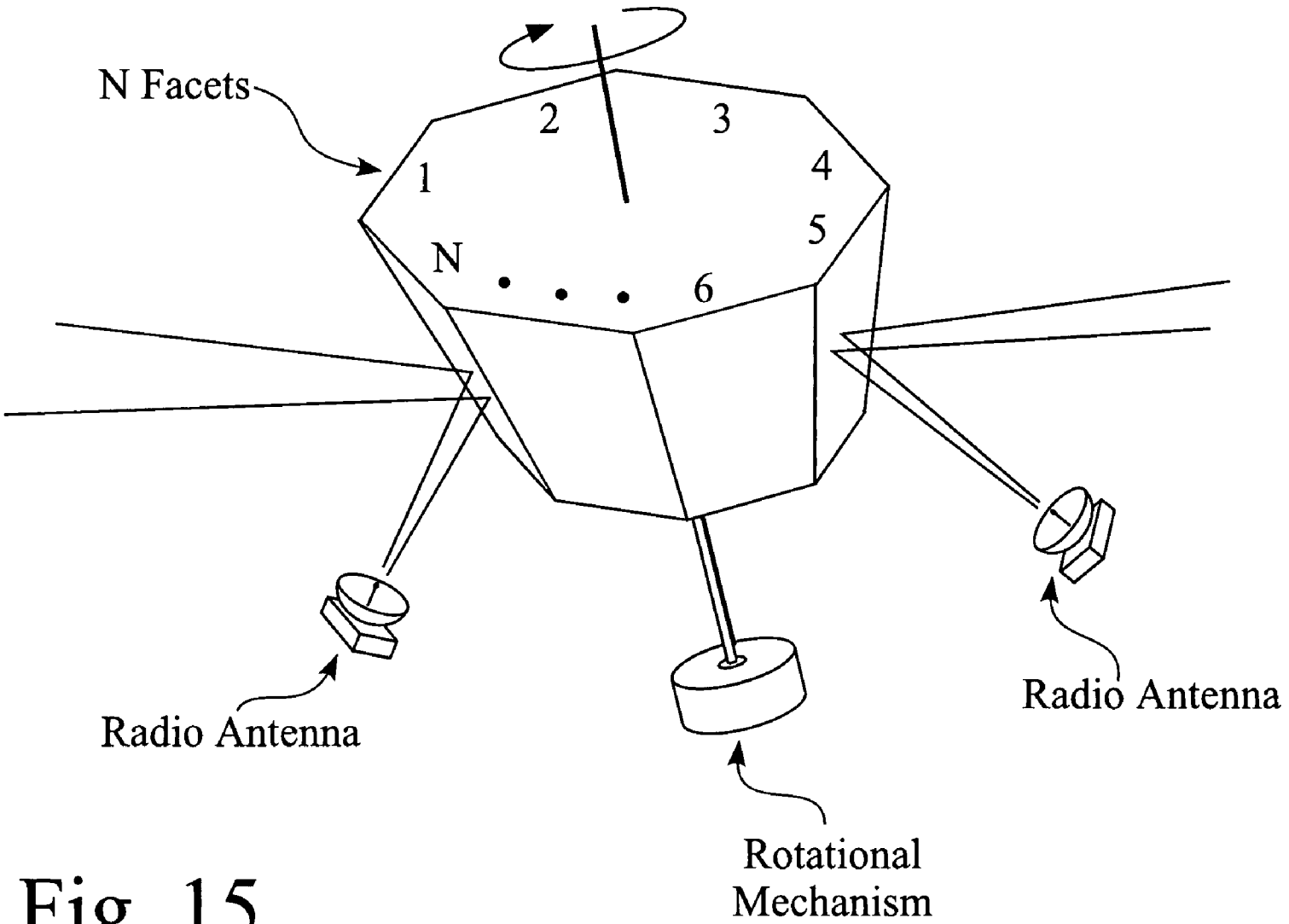

FIG. 15 presents a view of a mirror with multiple facets.

Figure 16:
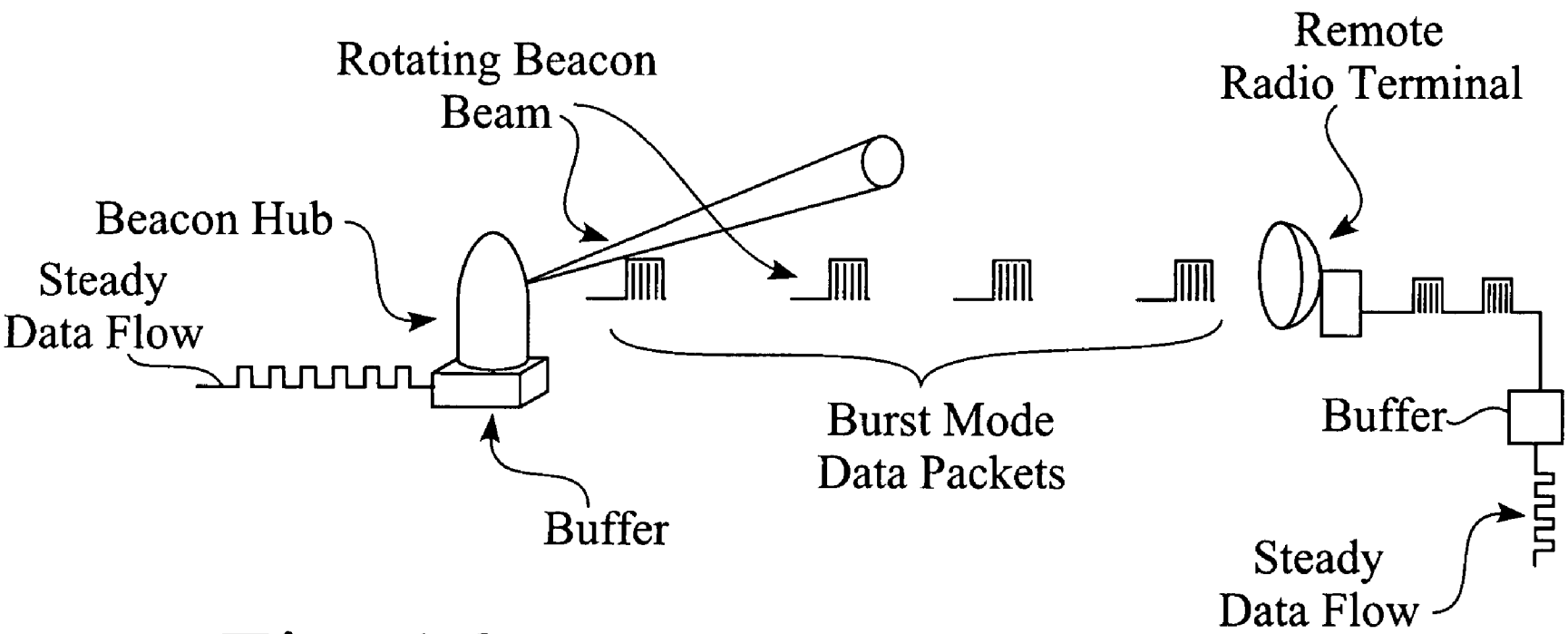
FIG. 16 is a schematic diagram that illustrates the system architecture of one embodiment of the invention.

FIG. 16 is a schematic diagram that illustrates the system architecture of one embodiment of the invention. A signal which contains a steady flow of data is fed through a buffer to a beacon hub. The rotating beacon produces a beam which resembles a train of signals that may also be described as a sequence of "burst mode" data packets. The remote terminal receives these signals, which are, in turn, fed through a buffer which provides a continuous, steady flow of data at the receiving end.

Figure 17:
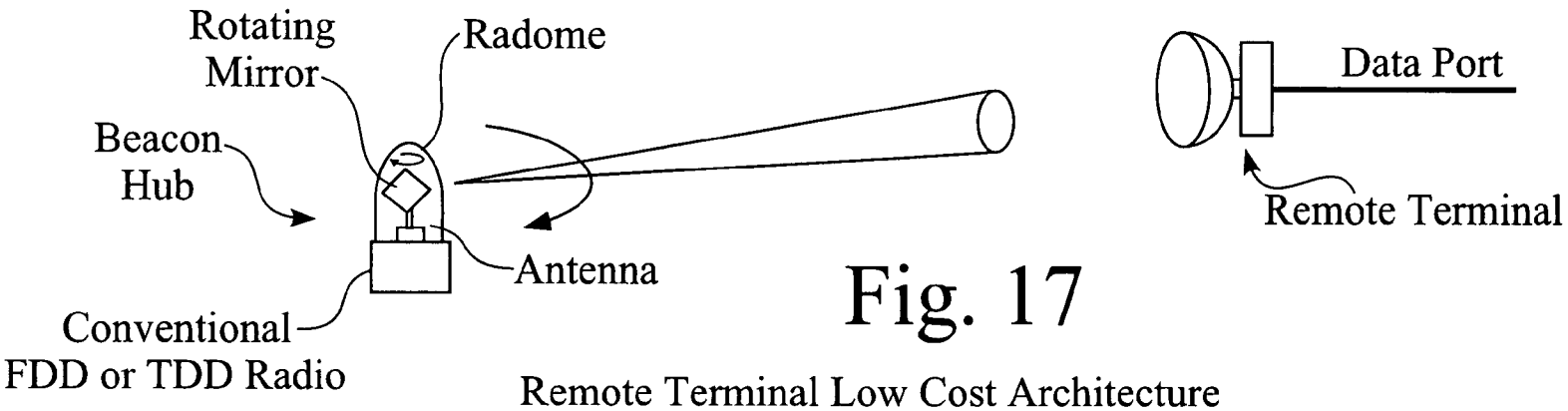
FIG. 17 and FIG. 18 depict a low cost terminal architecture.
Figure 18:
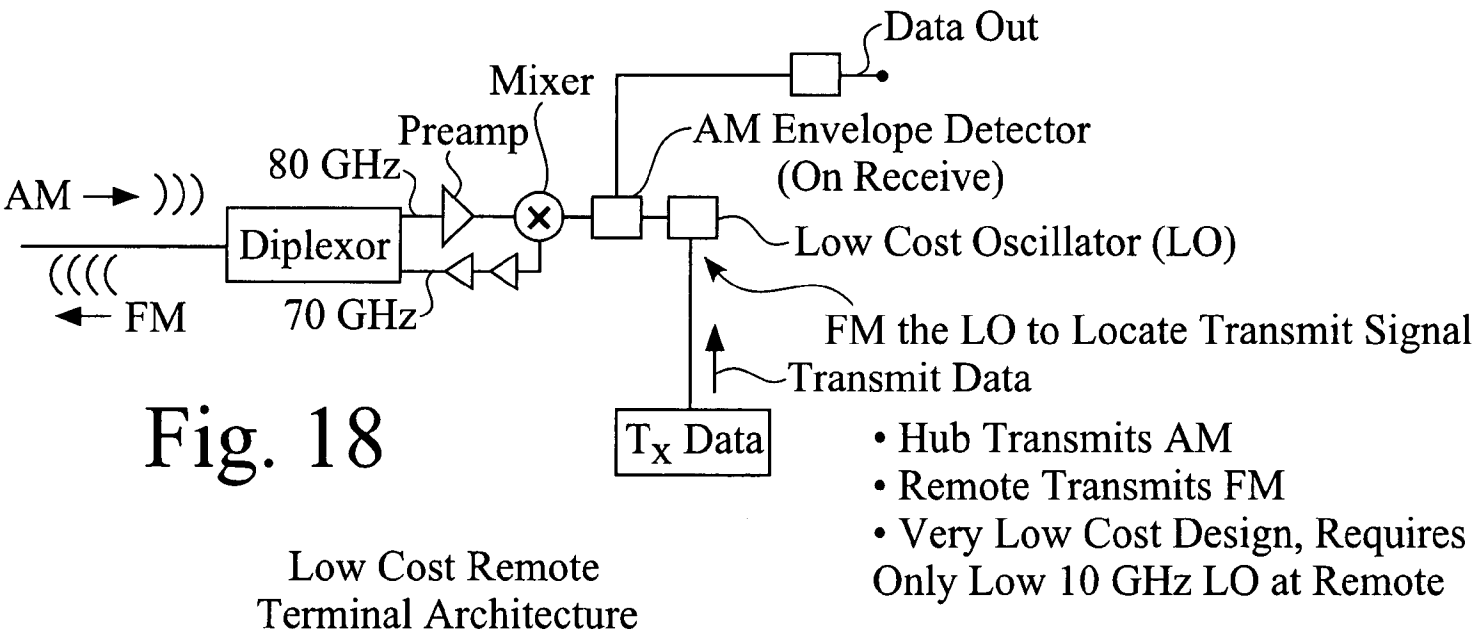

FIG. 17 and FIG. 18 show the details of a low cost terminal architecture. A radio frequency signal is fed into a mixer to generate a transmitted signal. The mixer employs a low cost 10 GHz oscillator as the local oscillator. When the invention operates at the 70 and 80 GHz bands, this configuration takes advantage of the of the 5 GHz separation of the bands. The 10 GHz signal is divided by two, either in the mixer or by using an external divider circuit. An FM signal is superimposed on the transmit side of the hub, and an AM signal is inserted on the transmitter on the remote side. The data rates offered by this configuration are low compared to the 5 GHz band at 71-76 GHz and 81-86 GHz.

FIG. 19 illustrates yet another embodiment of the invention, which has been combined with the system described in U.S. Pat. No. 6,665,296 issued to Sturza and Liron on 16 Dec. 2003, and entitled Network Access Communication System. The disclosure of U.S. Pat. No. 6,665,296 is hereby incorporated by reference.

FIG. 20 reveals another alternative embodiment of the invention, which is implemented in combination with power lines to provide data communications along both long haul utility lines and on internal wiring within a building or structure.

FIG. 21 is a schematic diagram of an exemplary millimeter wave radio of one embodiment of the invention.

Rotating Feed Luneberg Lens

An alternative to a rotating reflector or moving mirror is to use an antenna system having a fixed Luneberg lens with a rotating feed arm as shown in FIG. 22. The feed arm consists of 50 feed horns, one for each of the 50 elevation cells (50-deg divided by 1-deg per cell). Each of the feed horns is pointed towards the center of the lens. The feed arm rotates around the lens at 500 to 15,000 revolutions per minute (RPM). Sectors are addressed by time, the time the feed arm is on the opposite side of the lens from the sector being addressed, and elevation cells are addressed by selecting the corresponding feed horn. All 50 of the feed horns are active all of the time. In one version, adjacent horns operate on different polarizations to prevent interference. In another version, adjacent feed horns operate in different frequency sub-bands to prevent interference. In still another version, both polarization and frequency sub-band are alternated. The feed arm can also be designed to allow only one of the horns to transmit/receive at any given time, or it can be designed to allow multiple horns to transmit/receive simultaneously.

Another variation is an antenna system having a single feed horn that rotates around the Luneberg lens in a pattern to ensure that every cell is addressed with equal time in each complete pattern, as seen in FIG. 23. As the feed arm rotates around the lens, the second rotating plate moves the feed horn up and down tracing out all of the cells. The feed horn is gimbaled such that it always points at the center of the lens.

Rotating 1-D Rotman Lens

FIG. 24 shows a rotating 1-D Rotman lens antenna system. The antenna elements provide a 1-deg azimuth beamwidth and the Rotman lens provides elevation steering over +/−25-deg with a 1-deg beamwidth. The antenna system rotates at 500 to 15,000 revolutions per minute (RPM). Sectors are addressed by time, the time the antenna system is pointed towards the sector being addressed, and elevation cells are addressed by selecting the corresponding Rotman lens feed port.

Rotating 1-D Electronically Steered Phased Array

FIG. 25 and FIG. 26 show respective front and side views of a rotating 1-D electronically steered phased array antenna system. The phase array panel provides a 1-deg azimuth beamwidth and provides elevation steering over +/−25-deg with a 1-deg beamwidth. The 1-deg azimuth beamwidth can be obtained either by using radiating elements with 1-deg azimuth beamwidth or by forming a 1-deg azimuth beamwidth from multiple elements using fixed phase shifts between the elements. The antenna system rotates at 500 to 15,000 revolutions per minute (RPM). Sectors are addressed by time, the time the panel is pointed towards the sector being addressed, and elevation cells are addressed by steering the phased array.

Electronically Steered 2-D Phased Array

The advantage of an electronically 2-D steered phased array implementation is that capacity can be dynamically allocated on a cell by cell basis. With the rotating beacon approach, every sector is illuminated for the same dwell time, regardless of whether there are any subscribers in the sector, or if they have any traffic.

An electronically steered phased array can be steered very quickly, on the order of a few nanoseconds. Thus it can provide random access of the 18,000 cells. This allows the skipping of unused cells. For example, with the basic rotating beam concept a 1 Gbps beam only provides 2.7 Mbps per sector, even if only 10 of the sectors are occupied. With the phased array implementation, the beam can be time-shared between the 10 occupied sectors providing 100 Mbps to each.

Also, the electronically steered phased array supports variable dwell times per cell. With the basic rotating beam concept, the beam illuminates each sector for the same amount of time. With a variable dwell time phased array beam, capacity can be allocated dynamically. For example, a 1 Gbps beam could be allocated 200 Mbps to one cell, 100 Mbps to 3 other cells, 50 Mbps to 9 other cells, and 1 Mbps to 50 additional cells.

FIG. 27 and FIG. 28 show respective top and side views of an electronically steered 2-D three panel phased array that provides coverage of 360 degrees of azimuth and 50 degrees of elevation. Each panel generates a beam that can be steered +/−60-deg in azimuth and +/−25-deg in elevation.

An alternate embodiment of an electronically steered array is shown in FIG. 29 and FIG. 30. This one uses 4 panels with each panel generating a beam that can be steered +/−45-deg in azimuth and +/−25-deg in elevation. Other alternatives are to use additional panels, with the required plus/minus azimuth steering range given by 180-deg divided by the number of panels.

Rotating 2-D Electronically Steered Phased Array

A single electronically steered phased array panel is rotated at 500 to 15,000 revolutions per minute (RPM). This provides full 360-deg azimuth coverage with reduced phased array hardware. While an array panel with any azimuth coverage from +/−1-deg to +/−45-deg could be used, the preferred embodiment is +/−25-degrees. This azimuth steering range results in a rectangular panel, as seen in FIG. 31 and FIG. 32. This approach does not provide as much allocation flexibility as the multi-panel fixed electronically steered 2-D phased array system, but it provides significantly more flexibility then any of the other configurations described.

Low Cost CPE

This system can have most of the technology located at the hub and very limited technology at the ubiquitous customer premise locations. The customer premise equipment (CPE) antennas are fixed. They are aligned with the hub during installation and do not rotate or scan.

A functional block diagram of a typical CPE transceiver is shown in FIG. 33. For receiving data, the antenna converts the free-space propagated millimeterwave (MMW) waveform into an electrical signal. This signal is bandpass filtered to eliminate out-of-band interference and amplified by a low noise amplifier (LNA) to set the receiver noise floor. The amplified signal is bandpass filtered to limit the noise power coming from the LNA and downconverted to an intermediate frequency (IF) by mixing it with a local oscillator (LO) signal and lowpass filtering the mixer output. The LO signal is then converted to baseband using an I/Q demodulator. The baseband signals are then processed digitally to recover the data.

For transmitting, the digital data is used to generate baseband signals which are converted to an IF signal using an I/Q modulator. The IF signal is upconverted to the MMW transit frequency by mixing it with an LO signal and highpass filtering the mixer output. The MMW signal is then amplified by a power amplifier and bandpass filtered to eliminate out-of-band emissions. The filtered signal is converted to a free-space propagated waveform by the antenna. A MMW circulator is used to prevent interference from the CPE transmitter to the CPE receiver.

In-Band Local Oscillator (LO)

To simplify the CPE receiver, the hub transmits a continuous wave (CW) signal in addition to the MMW data signal. This CW signal provides the LO signal at the receiver. The first method for using it and exemplary spectrum are respectively is shown in FIG. 34 and FIG. 35. The CW signal is bandpass filtered, amplified, and applied to the mixer in place of the LO signal. A MMW data signal centered at 73.5 GHz with a 1 GHz bandwidth occupies the spectrum from 73 GHz to 74 GHz. Adding a CW signal at 72 GHz results in a recovered LO at the receiver at 72 GHz, and an IF frequency of 1.5 GHz. Alternatively, the LO signal could be on the high-side, at 75 GHz, also resulting in an IF frequency of 1.5 GHz. The advantage of this approach is that the CPE receiver does not have to generate a MMW LO signal. This approach can also be used in the 60, 80, and 90 GHz bands.

The second method for using the CW signal and exemplary spectrums are respectively shown in FIG. 36 and FIG. 37. The received signal is amplified and applied to a nonlinear device. The nonlinearity output is bandpass filtered at the IF frequency, which is equal to the absolute value of the MMW data signal center frequency minus the CW signal frequency, to recover the IF signal.

Out-of-Band Local Oscillator (LO)

Both methods can also be applied when the CW signal is out-of-band. Specifically, for a MMW data signal is one of the following four bands, 60-GHz, 70-GHz, 80-GHz, and 90-GHz, the CW signal can be in any one of the three other bands. For example, with a MMW data signal centered at 73.5 GHz, the CW signal can be at 83.5-GHz, resulting in a LO frequency of 10 GHz.

Transmit Simplification

The CW signal is also used as a LO for the CPE transmitter as shown in FIG. 38. FIG. 39 shows exemplary spectrums for a data signal, receive LO signal and transmit LO signal associated with the structure shown in FIG. 38. The LO signal is bandpass filtered, amplified, and applied to the mixer in place of the LO signal. The advantage of this approach is that the CPE transmitter does not have to generate a MMW LO signal. The CW signal can be in-band, or out-of-band.

Duplexing

FIG. 40 shows exemplary cell duplex transmission and reception for a system using frequency division duplex (FDD). The hub transmits to a cell on one MMW frequency, and the CPE in that cell transmit to the hub using a different frequency. This allows for simultaneous transmission and reception.

FIG. 41 shows exemplary cell duplex transmission and reception for an alternate, low cost system embodiment using time division duplex (TDD). The hub transmits to a cell for the first part of time that the beam dwells on that cell, and the CPE in that cell transmits back to the hub during the remaining portion of the dwell.

AM and FM

FIG. 42 is an exemplary schematic depiction of an exemplary AM transceiver that amplitude modulates (AM) the baseband signals on a MMW signal at the transmitter, and AM demodulates them at the receiver using an envelope detector.

FIG. 43 is a schematic view of an exemplary FM transceiver that frequency modulates (FM) the baseband data signals on a MMW carrier at the transmitter and FM demodulate them at the receiver using a frequency discriminator.

FIGS. 44-47 provide charts showing exemplary signal attenuation, such as by fog, rain and gases, as a function of frequency or wavelength.

CONCLUSION

Although the present invention has been described in detail with reference to one or more preferred embodiments, persons possessing ordinary skill in the art to which this invention pertains will appreciate that various modifications and enhancements may be made without departing from the spirit and scope of the Claims that follow. The various alternatives for providing a Multiple-Point to Multiple-Point Communication System that have been disclosed above are intended to educate the reader about preferred embodiments of the invention, and are not intended to constrain the limits of the invention or the scope of Claims.

What is claimed is:

1. An apparatus comprising:

a first transceiver and antenna means for producing a first beam at a frequency generally above 70 GHz;

said first transceiver and antenna means being located generally at the center of a cell;

a motion means for imparting motion to said first beam; and a second transceiver and antenna means being located in said cell;

said first and said second transceiver and antenna means providing a wireless link between said first and second transceiver and antenna means at a data rate generally above one Gigabit per second;

said first and second transceiver and antenna means working in combination with said antennas to utilize narrow beams which subtend generally less than one degree.

2. An apparatus as recited in claim 1, in which said motion means is a rotating platform; said rotating platform being generally coupled to said first transceiver and antenna means.

3. An apparatus as recited in claim 2 further comprising:

a generally vertical mast;

said generally vertical mast being physically coupled to said rotating platform.

4. An apparatus as recited in claim 3, in which said rotating platform is positioned generally on top of said vertical mast.

5. An apparatus as recited in claim 4, further comprising:

a bearing; said bearing being coupled to said generally vertically mast and for supporting said rotating platform.

6. An apparatus as recited in claim 2, further comprising a plurality of first transceiver and antenna means.

7. An apparatus as recited in claim 1, in which said motion means is a rotating mirror; said rotating mirror is physically independent from said first transceiver and antenna means.

8. An apparatus as recited in claim 7, in which said mirror may be titled to adjust the elevation of a reflected beam.

9. An apparatus as recited in claim 7, further comprising a plurality of mirrors for producing a plurality of reflected beams.

10. An apparatus as recited in claim 1, further comprising:

a phase control circuit for beam steering; said phase control circuit being coupled to said first transceiver and antenna means.

11. An apparatus as recited in claim 10, further comprising:

a plurality of radiating elements for beam steering; said plurality of radiating elements being coupled to said phase control circuit.

12. An apparatus as recited in claim 7, in which said first transceiver and antenna comprises includes a flat plate radio and antenna.

13. An apparatus as recited in claim 7, in which a plurality of antennas is positioned over said rotating mirror to produce a plurality of reflected beams.

14. An apparatus as recited in claim 7, in which two transceiver and antenna means are positioned on either side of said rotating mirror to produce two reflected beams.

15. An apparatus as recited in claim 1, in which said first transceiver and antenna means is installed on the top of a building.

16. An apparatus as recited in claim 1, in which a plurality of said first transceiver and antenna means are installed on the top of a building.

17. An apparatus as recited in claim 1, in which four of said first transceiver and antenna means are installed near the corners on the top of a building.

18. An apparatus as recited in claim 7, in which said rotating mirror comprises a mirror having a plurality of facets.

19. An apparatus as recited in claim 18, in which said mirror having a plurality of facets is an inverted tetrahedron.

20. An apparatus as recited in claim 1, further comprising:

a first and a second buffer circuit; said first and second buffer circuits being coupled to said first and said second transceiver and antenna means to provide a steady data flow.

* * * * *